US009805725B2

(12) United States Patent
Crockett et al.

(10) Patent No.: US 9,805,725 B2
(45) Date of Patent: Oct. 31, 2017

(54) OBJECT CLUSTERING FOR RENDERING OBJECT-BASED AUDIO CONTENT BASED ON PERCEPTUAL CRITERIA

(71) Applicant: Dolby Laboratories Licensing Corporation, San Francisco, CA (US)

(72) Inventors: Brett G. Crockett, Brisbane, CA (US); Alan J. Seefeldt, San Francisco, CA (US); Nicolas R. Tsingos, Palo Alto, CA (US); Rhonda Wilson, San Francisco, CA (US); Dirk Jeroen Breebaart, Pyrmont (AU); Lie Lu, Beijing (CN); Lianwu Chen, Beijing (CN)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 41 days.

(21) Appl. No.: 14/654,460

(22) PCT Filed: Nov. 25, 2013

(86) PCT No.: PCT/US2013/071679

§ 371 (c)(1),
(2) Date: Jun. 19, 2015

(87) PCT Pub. No.: WO2014/099285

PCT Pub. Date: Jun. 26, 2014

(65) Prior Publication Data

US 2015/0332680 A1 Nov. 19, 2015

Related U.S. Application Data

(60) Provisional application No. 61/745,401, filed on Dec. 21, 2012, provisional application No. 61/865,072, filed on Aug. 12, 2013.

(51) Int. Cl.
*H04R 5/00* (2006.01)
*G10L 19/008* (2013.01)
(Continued)

(52) U.S. Cl.
CPC ..... *G10L 19/008* (2013.01); *G10L 19/02* (2013.01); *G10L 19/20* (2013.01); *G10L 25/18* (2013.01);
(Continued)

(58) Field of Classification Search
USPC ..... 700/94; 381/23, 104, 106
See application file for complete search history.

(56) References Cited

U.S. PATENT DOCUMENTS 5,598,507 A 1/1997 Kimber
5,642,152 A 6/1997 Douceur
(Continued)

FOREIGN PATENT DOCUMENTS

CN 101473645 7/2009
CN 101821799 9/2010
(Continued)

OTHER PUBLICATIONS

Koo, K. et al "Variable Subband Analysis for High Quality Spatial Audio Object Coding" IEEE 10th International Conference on Advanced Communication Technology, Feb. 17-20, 2008, pp. 1205-1208.

(Continued)

*Primary Examiner* — Joseph Saunders, Jr.
*Assistant Examiner* — James Mooney

(57) ABSTRACT

Embodiments are directed a method of rendering object-based audio comprising determining an initial spatial position of objects having object audio data and associated metadata, determining a perceptual importance of the objects, and grouping the audio objects into a number of
(Continued)

clusters based on the determined perceptual importance of the objects, such that a spatial error caused by moving an object from an initial spatial position to a second spatial position in a cluster is minimized for objects with a relatively high perceptual importance. The perceptual importance is based at least in part by a partial loudness of an object and content semantics of the object.

20 Claims, 15 Drawing Sheets

(51) Int. Cl.

| | |
|---|---|
| ***G10L 25/18*** | (2013.01) |
| ***G10L 19/02*** | (2013.01) |
| ***H04S 7/00*** | (2006.01) |
| ***G10L 19/20*** | (2013.01) |

(52) U.S. Cl.
CPC ..... *H04S 7/30* (2013.01); *H04S 2400/13* (2013.01); *H04S 2420/03* (2013.01)

(56) References Cited

U.S. PATENT DOCUMENTS

| | | | | |
|---|---|---|---|---|
| 6,108,626 | A * | 8/2000 | Cellario | H04B 1/667 704/205 |
| 7,149,755 | B2 | 12/2006 | Obrador | |
| 7,340,458 | B2 | 3/2008 | Vaithilingam | |
| 7,711,123 | B2 | 5/2010 | Crockett | |
| 7,747,625 | B2 | 6/2010 | Gargi | |
| 2002/0184193 | A1 | 12/2002 | Cohen | |
| 2005/0114121 | A1 | 5/2005 | Tsingos | |
| 2009/0017676 | A1 | 1/2009 | Liao | |
| 2009/0271433 | A1 | 10/2009 | Perronnin | |
| 2011/0013790 | A1* | 1/2011 | Hilpert | G10L 19/008 381/300 |
| 2011/0075851 | A1* | 3/2011 | LeBoeuf | H04R 29/00 381/56 |
| 2014/0023197 | A1* | 1/2014 | Xiang | H04S 1/007 381/17 |
| 2014/0133683 | A1 | 5/2014 | Robinson | |

FOREIGN PATENT DOCUMENTS

| | | |
|---|---|---|
| CN | 101926181 | 12/2010 |
| CN | 102100088 | 6/2011 |
| EP | 1650765 | 4/2006 |
| JP | 2005-309609 | 11/2005 |
| JP | 2009-020461 | 1/2009 |
| JP | 2009-532372 | 9/2009 |
| JP | 2011-501823 | 1/2011 |
| RS | 1332 U | 8/2013 |

OTHER PUBLICATIONS

Stanojevic, T. et al "The Total Surround Sound System", 86th AES Convention, Hamburg, Mar. 7-10, 1989.
Stanojevic, T. et al "Designing of TSS Halls" 13th International Congress on Acoustics, Yugoslavia, 1989.
Stanojevic, T. et al "TSS System and Live Performance Sound" 88th AES Convention, Montreux, Mar. 13-16, 1990.
Stanojevic, Tomislav "3-D Sound in Future HDTV Projection Systems" presented at the 132nd SMPTE Technical Conference, Jacob K. Javits Convention Center, New York City, Oct. 13-17, 1990.
Stanojevic, T. "Some Technical Possibilities of Using the Total Surround Sound Concept in the Motion Picture Technology", 133rd SMPTE Technical Conference and Equipment Exhibit, Los Angeles Convention Center, Los Angeles, California, Oct. 26-29, 1991.
Stanojevic, T. et al. "TSS Processor" 135th SMPTE Technical Conference, Oct. 29-Nov. 2, 1993, Los Angeles Convention Center, Los Angeles, California, Society of Motion Picture and Television Engineers.
Stanojevic, Tomislav, "Virtual Sound Sources in the Total Surround Sound System" Proc. 137th SMPTE Technical Conference and World Media Expo, Sep. 6-9, 1995, New Orleans Convention Center, New Orleans, Louisiana.
Stanojevic, T. et al "The Total Surround Sound (TSS) Processor" SMPTE Journal, Nov. 1994.
Stanojevic, Tomislav "Surround Sound for a New Generation of Theaters, Sound and Video Contractor" Dec. 20, 1995.
Raake, A. et al "Concept and Evaluation of a Downward-Compatible System for Spatial Teleconferencing Using Automatic Speaker Clustering" 8th Annual Conference of the International Speech Communication Association, Aug. 2007, p. 1873-1876, vol. 3.
Miyabe, S. et al "Temporal Quantization of Spatial Information Using Directional Clustering for Multichannel Audio Coding" Oct. 18-21, 2009, IEEE Workshop on Applications of Signal Processing to Audio and Acoustics, pp. 261-264.
Tsingos, N. et al "Perceptual Audio Rendering of Complex Virtual Environments" ACM Transactions on Graphics, vol. 23, No. 3, Aug. 1, 2004, pp. 249-258.
"Dolby Atmos Next-Generation Audio for Cinema" Apr. 1, 2012.
Moore, B. et al, "A Model for the Prediction of Thresholds, Loudness, and Partial Loudness," Journal of the Audio Engineering Society (AES), vol. 5, Issue 4, pp. 224-240, Apr. 1997.

* cited by examiner

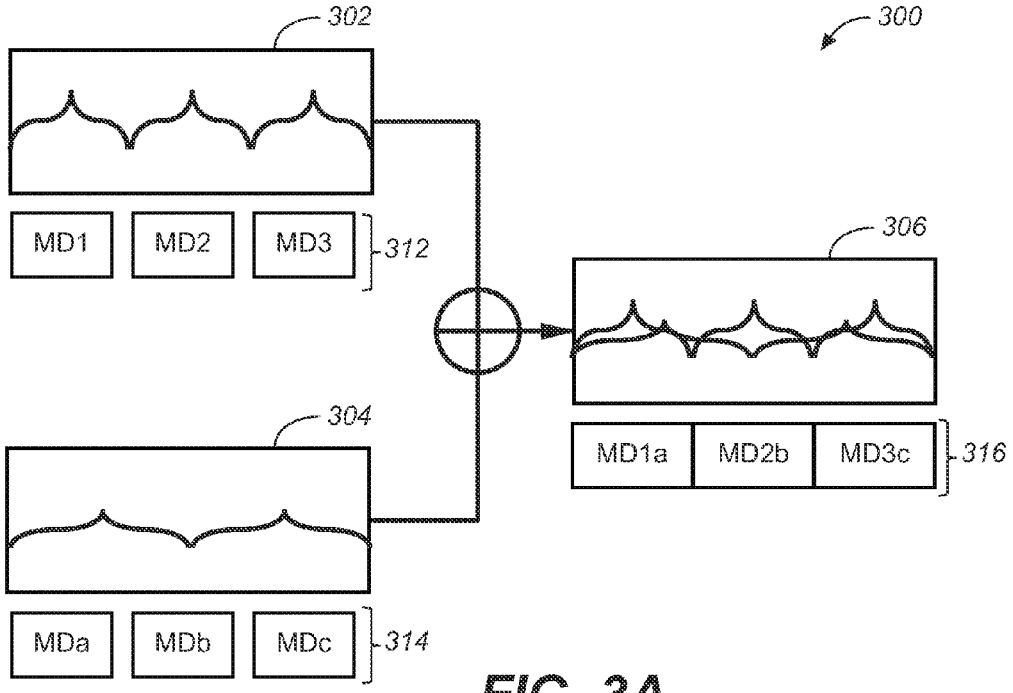

FIG. 3A

350

| 352 METADATA TYPE | 354 METADATA ELEMENTS | 356 COMBINATION |
|---|---|---|
| POSITION | Coordinate Value | Weighted Average |
| WIDTH | Scalar Value | Weighted Average |
| CONTENT TYPE/ COMBINED CONTENT TYPE | Probability Measure: Dialog/music/ambient/effects | Probability Average or Select Type of Dominant Object |
| LOUDNESS/ PARTIAL LOUDNESS/ COMBINED LOUDNESS | Energy or dB value | Average |
| RENDERING MODES | Integer Value Mode 1, Mode 2, etc. | Select Mode of Dominant Object |
| CONTROL SIGNALS | Driver Assignments Fixed Channel/Mobile Object | Application Specific |

FIG. 3B

OBJECT CLUSTERING FOR RENDERING OBJECT-BASED AUDIO CONTENT BASED ON PERCEPTUAL CRITERIA

CROSS-REFERENCE TO RELATED APPLICATIONS

This application claims the benefit of priority to U.S. Provisional Patent Application No. 61/745,401 filed 21 Dec. 2012 and U.S. Provisional Application No. 61/865,072 filed 12 Aug. 2013, hereby incorporated by reference in entirety.

TECHNICAL FIELD OF THE INVENTION

One or more embodiments relate generally to audio signal processing, and more specifically to clustering audio objects based on perceptual criteria to compress object-based audio data for efficient coding and/or rendering through various playback systems.

BACKGROUND OF THE INVENTION

The advent of object-based audio has significantly increased the amount of audio data and the complexity of rendering this data within high-end playback systems. For example, cinema sound tracks may comprise many different sound elements corresponding to images on the screen, dialog, noises, and sound effects that emanate from different places on the screen and combine with background music and ambient effects to create the overall auditory experience. Accurate playback requires that sounds be reproduced in a way that corresponds as closely as possible to what is shown on screen with respect to sound source position, intensity, movement, and depth. Object-based audio represents a significant improvement over traditional channel-based audio systems that send audio content in the form of speaker feeds to individual speakers in a listening environment, and are thus relatively limited with respect to spatial playback of specific audio objects.

The introduction of digital cinema and the development of three-dimensional ("3D") content has created new standards for sound, such as the incorporation of multiple channels of audio to allow for greater creativity for content creators, and a more enveloping and realistic auditory experience for audiences. Expanding beyond traditional speaker feeds and channel-based audio as a means for distributing spatial audio is critical, and there has been considerable interest in a model-based audio description that allows the listener to select a desired playback configuration with the audio rendered specifically for their chosen configuration. The spatial presentation of sound utilizes audio objects, which are audio signals with associated parametric source descriptions of apparent source position (e.g., 3D coordinates), apparent source width, and other parameters. Further advancements include a next generation spatial audio (also referred to as "adaptive audio") format has been developed that comprises a mix of audio objects and traditional channel-based speaker feeds (beds) along with positional metadata for the audio objects.

In some soundtracks, there may be several (e.g., 7, 9, or 11) bed channels containing audio. Additionally, based on the capabilities of an authoring system there may be tens or even hundreds of individual audio objects that are combined during rendering to create a spatially diverse and immersive audio experience. In some distribution and transmission systems, there may be large enough available bandwidth to transmit all audio bed and objects with little or no audio compression. In some cases, however, such as Blu-ray disc, broadcast (cable, satellite and terrestrial), mobile (3G and 4G) and over-the-top (OTT, or Internet) distribution there may be significant limitations on the available bandwidth to digitally transmit all of the bed and object information created at the time of authoring. While audio coding methods (lossy or lossless) may be applied to the audio to reduce the required bandwidth, audio coding may not be sufficient to reduce the bandwidth required to transmit the audio, particularly over very limited networks such as mobile 3G and 4G networks.

Some prior methods have been developed to reduce the number of input objects and beds into a smaller set of output objects by means of clustering. Essentially, objects with similar spatial or rendering attributes are combined into single or fewer new, merged objects. The merging process encompasses combining the audio signals (for example by summation) and the parametric source descriptions (for example by averaging). The allocation of objects to clusters in these previous methods is based on spatial proximity. That is, objects that have similar parametric position data are combined into one cluster while ensuring a small spatial error for each object individually. This process is generally effective as long as the spatial positions of all perceptually relevant objects in the content allow for such clustering with reasonably small error. In very complex content, however, with many objects active simultaneously having a sparse spatial distribution, the number of required output clusters to accurately model such content can become significant when only moderate spatial errors are tolerated. Alternatively, if the number of output clusters is restricted, such as due to bandwidth or complexity constraints, complex content may be reproduced with a degraded spatial quality due to the constrained clustering process and the significant spatial errors. Hence in that case, the use of proximity only to define the clusters often returns suboptimal results. In this case, the importance of objects themselves, as opposed to just their spatial position, should be taken into account to optimize the perceived quality of the clustering process.

Other solutions have also been developed to improve the clustering process. One such solution is a culling process that removes objects that are perceptually irrelevant, such as due to masking or due to an object being silent. Although this process helps to improve clustering process, it does not provide an improved clustering result if the number of perceptually relevant objects is larger than the available output clusters.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF EMBODIMENTS

Some embodiments are directed to compressing object-based audio data for rendering in a playback system by identifying a first number of audio objects to be rendered in a playback system, where each audio object comprises audio data and associated metadata; defining an error threshold for certain parameters encoded within the associated metadata for each audio object; and grouping audio objects of the first number of audio objects into a reduced number of audio objects based on the error threshold so that the amount of data for the audio objects transmitted through the playback system is reduced.

Some embodiments are further directed to rendering object-based audio by identifying a spatial location of each object of a number of objects at defined time intervals, and grouping at least some of the objects into one or more time-varying clusters based on a maximum distance between pairs of objects and/or distortion errors caused by the grouping on certain other characteristics associated with the objects.

Some embodiments are directed to a method of compressing object-based audio data for rendering in a playback system by determining a perceptual importance of objects in an audio scene, wherein the objects comprise object audio data and associated metadata, and combining certain audio objects into clusters of audio objects based on the determined perceptual importance of the objects, wherein a number of clusters is less than an original number of objects in the audio scene. In this method, the perceptual importance may be a value derived from at least one of a loudness value and a content type of the respective object, and the content type is at least one of dialog, music, sound effects, ambiance, and noise.

In an embodiment of the method, the content type is determined by an audio classification process that receives an input audio signal for the audio objects and the loudness is obtained by a perceptual model based on a calculation of excitation levels in critical frequency bands of the input audio signal, with the method further comprising defining a centroid for a cluster around a first object of the audio objects and aggregating all excitation of the audio objects. The loudness value may be dependent at least in part on spatial proximity of a respective object to the other objects, and the spatial proximity may be defined at least in part by a position metadata value of the associated metadata for the respective object. The act of combining may cause certain spatial errors associated with each clustered object. In an embodiment, the method further comprises clustering the objects such that a spatial error is minimized for objects of relatively high perceptual importance. In an embodiment, the determined perceptual importance of the objects depends on a relative spatial location of the objects in the audio scene, and step of combining further comprises determining a number of centroids, with each centroid comprising a center of a cluster for grouping a plurality of audio objects, the centroid positions being dependent on the perceptual importance of one or more audio objects relative to other audio objects, and grouping the objects into one or more clusters by distributing object signals across the clusters. The clustering may further comprise grouping an object with a nearest neighbor, or distributing an object over one or more clusters using a panning method.

The act of combining audio objects may involve combining waveforms embodying the audio data for the constituent objects within the same cluster together to form a replacement object having a combined waveform of the constituent objects, and combining the metadata for the constituent objects within the same cluster together to form a replacement set of metadata for the constituent objects.

Some embodiments are further directed to a method of rendering object-based audio by defining a number of centroids, with each centroid comprising a center of a cluster for grouping a plurality of audio objects, determining a first spatial location of each object relative to the other objects of the plurality of audio objects, determining a relative importance of each audio object of the plurality of audio objects, said relative importance depending on the relative spatial locations of objects, determining a number of centroids, each centroid comprising a center of a cluster for grouping a plurality of audio objects, the centroid positions being dependent on the relative importance of one or more audio objects, and grouping the objects into one or more clusters by distributing object signals across the clusters. This method may further comprise determining a partial loudness of each audio object of the plurality of audio objects and a content type and associated content type importance of each audio object of the plurality of audio objects. In an embodiment, the partial loudness and the content type of each audio object are combined to determine the relative importance of a respective audio object. Objects are clustered such that a spatial error is minimized for objects of relatively high perceptual importance, where the spatial error may be caused by moving an object from a first perceived source location to a second perceived source location when clustered with other objects.

Some further embodiments are described for systems or devices and computer-readable media that implement the embodiments for the method of compressing or the method of rendering described above.

The methods and systems described herein may be implemented in an audio format and system that includes updated content creation tools, distribution methods and an enhanced user experience based on an adaptive audio system that includes new speaker and channel configurations, as well as a new spatial description format made possible by a suite of advanced content creation tools. In such a system, audio streams (generally including channels and objects) are transmitted along with metadata that describes the content creator's or sound mixer's intent, including desired position of the audio stream. The position can be expressed as a named channel (from within the predefined channel configuration) or as three-dimensional (3D) spatial position information.

INCORPORATION BY REFERENCE

Each publication, patent, and/or patent application mentioned in this specification is herein incorporated by reference in its entirety to the same extent as if each individual publication and/or patent application was specifically and individually indicated to be incorporated by reference.

BRIEF DESCRIPTION OF THE DRAWINGS

In the following drawings like reference numbers are used to refer to like elements. Although the following figures depict various examples, the one or more implementations are not limited to the examples depicted in the figures.

FIG. 3A illustrates the combination of audio signals and metadata for two objects to create a combined object, under an embodiment.

FIG. 3B is a table that illustrates example metadata definitions and combination methods for a clustering process, under an embodiment.

DETAILED DESCRIPTION OF THE INVENTION

Figure 1:
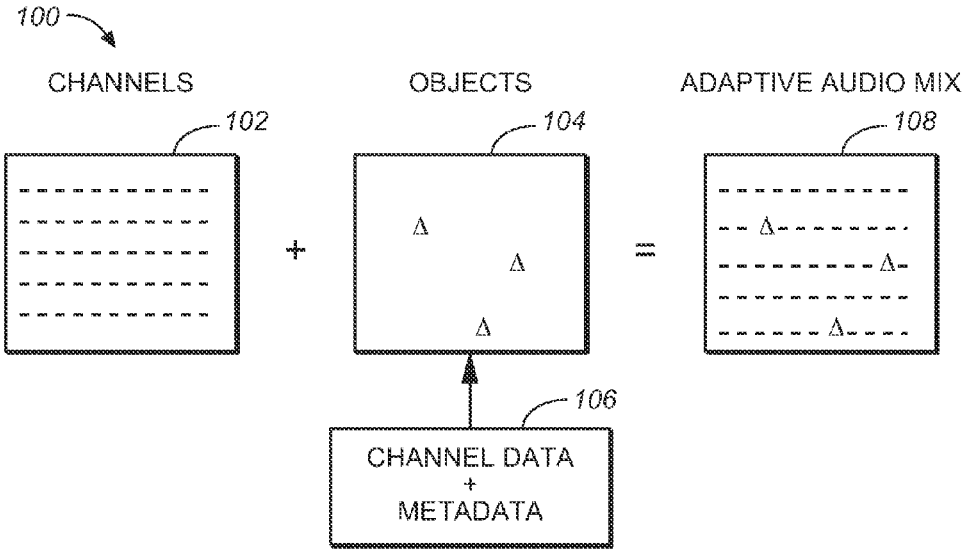
FIG. 1 illustrates the combination of channel and object-based data to produce an adaptive audio mix, under an embodiment.

Systems and methods are described for an object clustering-based compression scheme for object-based audio data. Embodiments of the clustering scheme utilize the perceptual importance of objects for allocating objects to clusters, and expands on clustering methods that are position and proximity-based. A perceptual-based clustering system augments proximity-based clustering with perceptual correlates derived from the audio signals of each object to derive an improved allocation of objects to clusters in constrained conditions, such as when the number of perceptually-relevant objects is larger than the number of output clusters.

In an embodiment of an audio processing system, an object combining or clustering process is controlled in part by the spatial proximity of the objects, and also by certain perceptual criteria. In general, clustering objects results in a certain amount of error since not all input objects can maintain spatial fidelity when clustered with other objects, especially in applications where a large number of objects are sparsely distributed. Objects with relatively high perceived importance will be favored in terms of minimizing spatial/perceptual errors with the clustering process. The object importance can be based on factors such as partial loudness, which is the perceived loudness of an object factoring the masking effects among other objects in the scene, and content semantics or type (e.g., dialog, music, effects, etc.).

Aspects of the one or more embodiments described herein may be implemented in an audio or audio-visual (AV) system that processes source audio information in a mixing, rendering and playback system that includes one or more computers or processing devices executing software instructions. Any of the described embodiments may be used alone or together with one another in any combination. Although various embodiments may have been motivated by various deficiencies with the prior art, which may be discussed or alluded to in one or more places in the specification, the embodiments do not necessarily address any of these deficiencies. In other words, different embodiments may address different deficiencies that may be discussed in the specification. Some embodiments may only partially address some deficiencies or just one deficiency that may be discussed in the specification, and some embodiments may not address any of these deficiencies.

For purposes of the present description, the following terms have the associated meanings: the term "channel" or "bed" means an audio signal plus metadata in which the position is coded as a channel identifier, e.g., left-front or right-top surround; "channel-based audio" is audio formatted for playback through a pre-defined set of speaker zones with associated nominal locations, e.g., 5.1, 7.1, and so on; the term "object" or "object-based audio" means one or more audio channels with a parametric source description, such as apparent source position (e.g., 3D coordinates), apparent source width, etc.; "adaptive audio" means channel-based and/or object-based audio signals plus metadata that renders the audio signals based on the playback environment using an audio stream plus metadata in which the position is coded as a 3D position in space; and "rendering" means conversion to electrical signals used as speaker feeds.

In an embodiment, the scene simplification process using object clustering is implemented as part of an audio system that is configured to work with a sound format and processing system that may be referred to as a "spatial audio system" or "adaptive audio system." Such a system is based on an audio format and rendering technology to allow enhanced audience immersion, greater artistic control, and system flexibility and scalability. An overall adaptive audio system generally comprises an audio encoding, distribution, and decoding system configured to generate one or more bitstreams containing both conventional channel-based audio elements and audio object coding elements. Such a combined approach provides greater coding efficiency and rendering flexibility compared to either channel-based or object-based approaches taken separately. An example of an adaptive audio system that may be used in conjunction with present embodiments is described in pending International Patent Application No. PCT/US2012/044388 filed 27 Jun. 2012, and entitled "System and Method for Adaptive Audio Signal Generation, Coding and Rendering," which is hereby incorporated by reference. An example implementation of an adaptive audio system and associated audio format is the Dolby® Atmos™ platform. Such a system incorporates a height (up/down) dimension that may be implemented as a 9.1 surround system, or similar surround sound configuration.

Audio objects can be considered individual or collections of sound elements that may be perceived to emanate from a particular physical location or locations in the listening environment. Such objects can be static (that is, stationary) or dynamic (that is, moving). Audio objects are controlled by metadata that defines the position of the sound at a given point in time, along with other functions. When objects are played back, they are rendered according to the positional metadata using the speakers that are present, rather than necessarily being output to a predefined physical channel. A track in a session can be an audio object, and standard panning data is analogous to positional metadata. In this way, content placed on the screen might pan in effectively the same way as with channel-based content, but content placed in the surrounds can be rendered to individual speakers, if desired. While the use of audio objects provides control over discrete effects, other aspects of a soundtrack may work more effectively in a channel-based environment. For example, many ambient effects or reverberation actually benefit from being fed to arrays of speakers rather than individual drivers. Although these could be treated as objects with sufficient width to fill an array, it is beneficial to retain some channel-based functionality.

The adaptive audio system is configured to support "beds" in addition to audio objects, where beds are effectively channel-based sub-mixes or stems. These can be delivered for final playback (rendering) either individually, or combined into a single bed, depending on the intent of the content creator. These beds can be created in different channel-based configurations such as 5.1, 7.1, and 9.1, and arrays that include overhead speakers. FIG. 1 illustrates the combination of channel and object-based data to produce an adaptive audio mix, under an embodiment. As shown in process 100, the channel-based data 102, which, for example, may be 5.1 or 7.1 surround sound data provided in the form of pulse-code modulated (PCM) data is combined with audio object data 104 to produce an adaptive audio mix 108. The audio object data 104 is produced by combining the elements of the original channel-based data with associated metadata that specifies certain parameters pertaining to the location of the audio objects. As shown conceptually in FIG. 1, the authoring tools provide the ability to create audio programs that contain a combination of speaker channel groups and object channels simultaneously. For example, an audio program could contain one or more speaker channels optionally organized into groups (or tracks, e.g., a stereo or 5.1 track), descriptive metadata for one or more speaker channels, one or more object channels, and descriptive metadata for one or more object channels.

An adaptive audio system extends beyond speaker feeds as a means for distributing spatial audio and uses advanced model-based audio descriptions to tailor playback configurations that suit individual needs and system constraints so that audio can be rendered specifically for individual configurations. The spatial effects of audio signals are critical in providing an immersive experience for the listener. Sounds that are meant to emanate from a specific region of a viewing screen or room should be played through speaker(s) located at that same relative location. Thus, the primary audio metadatum of a sound event in a model-based description is position, though other parameters such as size, orientation, velocity and acoustic dispersion can also be described.

As stated above, adaptive audio content may comprise several bed channels 102 along with many individual audio objects 104 that are combined during rendering to create a spatially diverse and immersive audio experience. In a cinema environment with a great deal of processing bandwidth, virtually any number of beds and objects can be created and accurately rendered in a theater. However, as cinema or other complex audio content is produced for distribution and reproduction in home or personal listening environments the relatively limited processing bandwidth of such devices and media prevent optimum rendering or playback of this content. For example, typical transmission media used for consumer and professional applications include Blu-ray disc, broadcast (cable, satellite and terrestrial), mobile (3G and 4G) and over the top (OTT) or Internet distribution. These media channels may pose significant limitations on the available bandwidth to digitally transmit all of the bed and object information of adaptive audio content. Embodiments are directed to mechanisms to compress complex adaptive audio content so that it may be distributed through transmission systems that may not possess large enough available bandwidth to otherwise render all of audio bed and object data.

With current monophonic, stereo and multichannel audio content, the bandwidth constraints of the aforementioned delivery methods and networks are such that audio coding is generally required to reduce the bandwidth required to match the available bandwidth of the distribution method. Present cinema systems are capable of providing uncompressed audio data at a bandwidth on the order of 10 Mbps for typical 7.1 cinema format. In comparison to this capacity, the available bandwidth for the various other delivery methods and playback systems is substantially less. For example, disc-based bandwidth is on the order of several hundred kbps up to tens of Mbps; broadcast bandwidth is on the order of several hundred kbps down to tens of kbps; OTT Internet bandwidth is on the order of several hundred kbps up to several Mbps; and mobile (3G/4G) is only on the order of several hundred kbps down to tens of kbps. Because adaptive audio contains additional audio essence that is part of the format, i.e., objects 104 in addition to channel beds 102, the already significant constraints on transmission bandwidth are exacerbated above and beyond normal channel based audio formats, and additional reductions in bandwidth are required in addition to audio coding tools to facilitate accurate reproduction in reduced bandwidth transmission and playback systems.

Scene Simplification Through Object Clustering

In an embodiment, an adaptive audio system provides a component to reduce the bandwidth of object-based audio content through object clustering and perceptually transparent simplifications of the spatial scenes created by the combination of channel beds and objects. An object clustering process executed by the component uses certain information about the objects, including spatial position, content type, temporal attributes, object width, and loudness, to reduce the complexity of the spatial scene by grouping like objects into object clusters that replace the original objects.

The additional audio processing for standard audio coding to distribute and render a compelling user experience based on the original complex bed and audio tracks is generally referred to as scene simplification and/or object clustering. The purpose of this processing is to reduce the spatial scene through clustering or grouping techniques that reduce the number of individual audio elements (beds and objects) to be delivered to the reproduction device, but that still retain enough spatial information so that the perceived difference between the originally authored content and the rendered output is minimized.

The scene simplification process facilitates the rendering of object-plus-bed content in reduced bandwidth channels or coding systems using information about the objects including spatial position, temporal attributes, content type, width, and other appropriate characteristics to dynamically cluster objects to a reduced number. This process can reduce the number of objects by performing the following clustering operations: (1) clustering objects to objects; (2) clustering object with beds; and (3) clustering objects and beds to objects. In addition, an object can be distributed over two or more clusters. The process further uses certain temporal and/or perceptual information about objects to control clustering and de-clustering of objects. Object clusters replace the individual waveforms and metadata elements of constituent objects with a single equivalent waveform and metadata set, so that data for N objects is replaced with data for a single object, thus essentially compressing object data from N to 1. As mentioned above, alternatively, or additionally, an object or bed channel may be distributed over more than one cluster (for example using amplitude panning techniques), compressing object data from N to M, with M<N. The clustering process utilizes an error metric based on distortion due to a change in location, loudness or other characteristic of the clustered objects to determine an optimum tradeoff between clustering compression versus sound degradation of the clustered objects. The clustering process can be performed synchronously or it can be event-driven, such as by using auditory scene analysis (ASA) and event boundary detection to control object simplification through clustering. In some embodiments, the process may utilize knowledge of endpoint rendering algorithms and devices to control clustering. In this way, certain characteristics or properties of the playback device may be used to inform the clustering process. For example, different clustering schemes may be utilized for speakers versus headphones or other audio drivers, or different clustering schemes may be utilized for lossless versus lossy coding, and so on.

For purposes of the following description, the terms 'clustering' and 'grouping' or 'combining' are used interchangeably to describe the combination of objects and/or beds (channels) to reduce the amount of data in a unit of adaptive audio content for transmission and rendering in an adaptive audio playback system; and the terms 'compression' or 'reduction' may be used to refer to the act of performing scene simplification of adaptive audio through such clustering of objects and beds. The terms 'clustering', 'grouping' or 'combining' throughout this description are not limited to a strictly unique assignment of an object or bed channel to a single cluster only, instead, an object or bed channel may be distributed over more than one output bed or cluster using weights or gain vectors that determine the relative contribution of an object or bed signal to the output cluster or output bed signal.

Figure 2A:
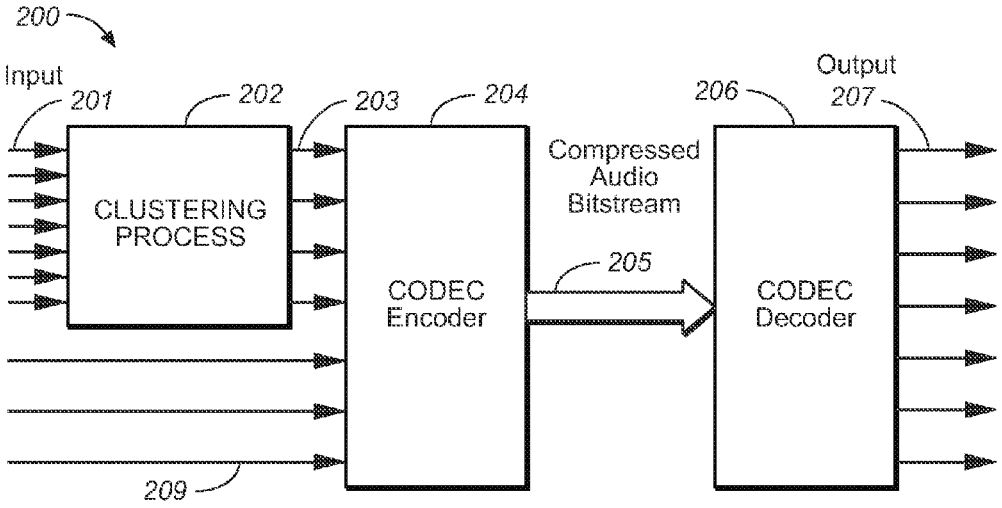
FIG. 2A is a block diagram of a clustering process in conjunction with a codec circuit for rendering of adaptive audio content, under an embodiment.

FIG. 2A is a block diagram of a clustering component executing a clustering process in conjunction with a codec circuit for rendering of adaptive audio content, under an embodiment. As shown in diagram 200, circuit 200 includes encoder 204 and decoder 206 stages that process input audio signals to produce output audio signals at a reduced bandwidth. For the example shown in FIG. 2A, a portion 209 of the input signals may be processed through known compression techniques to produce a compressed audio bitstream 205 that is decoded by decoder stage 206 to produce at least a portion of output 207. Such known compression techniques involve analyzing the input audio content 209, quantizing the audio data and then performing compression techniques, such as masking, etc. on the audio data itself. The compression techniques may be lossy or lossless and are implemented in systems that may allow the user to select a compressed bandwidth, such as 192 kbps, 256 kbps, 512 kbps, and so on.

In an adaptive audio system, at least a portion of the input audio comprises input signals 201 including objects that consist of audio and metadata. The metadata defines certain characteristics of the associated audio content, such as object spatial position, content type, loudness, and so on. Any practical number of audio objects (e.g., hundreds of objects) may be processed through the system for playback. To facilitate accurate playback of these multitude of objects in a wide variety of playback systems and transmission media, system 200 includes a clustering process or component 202 that reduces the number of objects into a smaller more manageable number of objects by combining the original objects into a smaller number of object groups. The clustering process thus builds groups of objects to produce a smaller number of output groups 203 from an original set of individual input objects 201. The clustering process 202 essentially processes the metadata of the objects as well as the audio data itself to produce the reduced number of object groups. The metadata is analyzed to determine which objects at any point in time are most appropriately combined with other objects, and the corresponding audio waveforms for the combined objects are then summed together to produce a substitute or combined object. The combined object groups are then input to the encoder 204, which generates a bitstream 205 containing the audio and metadata for transmission to the decoder 206.

In general, the adaptive audio system incorporating the object clustering process 202 includes components that generate metadata from the original spatial audio format. The codec circuit 200 comprises part of an audio rendering system configured to process one or more bitstreams containing both conventional channel-based audio elements and audio object coding elements. An extension layer containing the audio object coding elements is added to either one of the channel-based audio codec bitstream or the audio object bitstream. This approach enables bitstreams 205, which include the extension layer to be processed by renderers for use with existing speaker and driver designs or next generation speakers utilizing individually addressable drivers and driver definitions. The spatial audio content from the spatial audio processor comprises audio objects, channels, and position metadata. When an object is rendered, it is assigned to one or more speakers according to the position metadata, and the location of the playback speakers. Additional metadata may be associated with the object to alter the playback location or otherwise limit the speakers that are to be used for playback. Metadata may be generated in the audio workstation in response to the engineer's mixing inputs to provide rendering cues that control spatial parameters (e.g., position, velocity, intensity, timbre, etc.) and specify which driver(s) or speaker(s) in the listening environment play respective sounds during exhibition. The metadata is associated with the respective audio data in the workstation for packaging and transport by spatial audio processor.

Figure 2B:
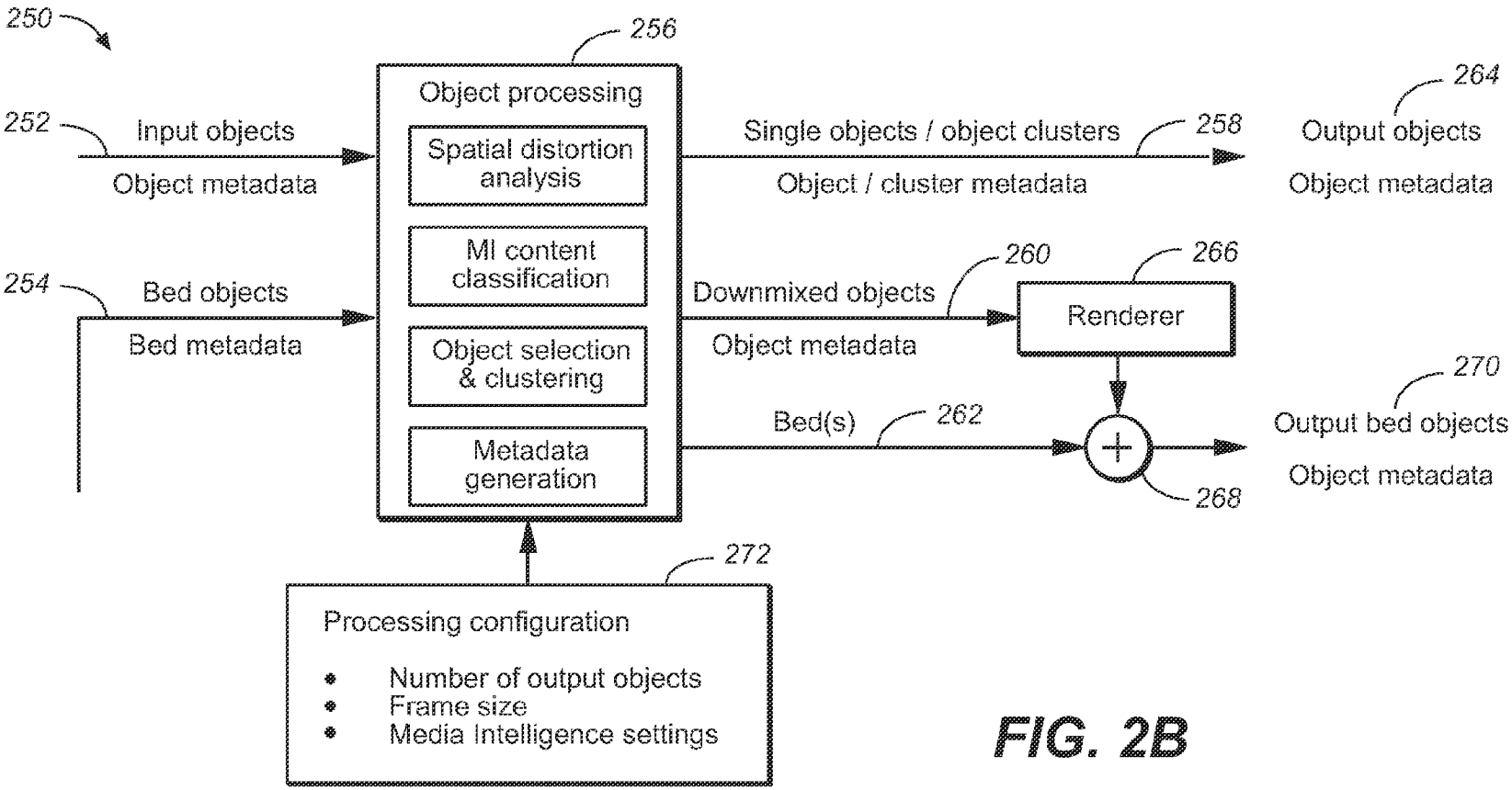
FIG. 2B illustrates clustering objects and beds in an adaptive audio processing system, under an embodiment.

FIG. 2B illustrates clustering objects and beds in an adaptive audio processing system, under an embodiment. As shown in diagram 250, an object processing component 256 performing certain scene simplification tasks reads in an arbitrary number of input audio files and metadata. The input audio files comprise input objects 252 and associated object metadata, and beds 254 and associated bed metadata. This input file/metadata thus correspond to either "beds" or "objects" tracks. The object processing component 256 combines media intelligence/content classification, spatial distortion analysis and object selection/clustering to create a smaller number of output objects and bed tracks. In particular, objects can be clustered together to create new equivalent objects or object clusters 258, with associated object/cluster metadata. The objects can also be selected for 'downmixing' into beds. This is shown as the output of downmixed objects 260 input to a renderer 266 for combination 268 with beds 262 to form output bed objects and associated metadata 270. The output bed configuration 270 (e.g., a typical 5.1 for the home) does not necessarily need to match the input bed configuration, which for example could be 9.1 for Atmos™ cinema. New metadata is generated for the output tracks by combining metadata from the input tracks. New audio is also generated for the output tracks by combining audio from the input tracks.

The object processing component 256 utilizes certain processing configuration information 272. In an embodiment, these include the number of output objects, the frame size and certain media intelligence settings. Media intelligence can include several parameters or characteristics associated with the objects, such as content type (i.e., dialog/music/effects/etc.), regions (segment/classification), preprocessing results, auditory scene analysis results, and other similar information.

In an alternative embodiment, audio generation could be deferred by keeping a reference to all original tracks as well simplification metadata (e.g., which objects belongs to which cluster, which objects are to be rendered to beds, etc.). This can be useful to distribute the simplification process between a studio and an encoding house, or other similar scenario.

Figure 2C:
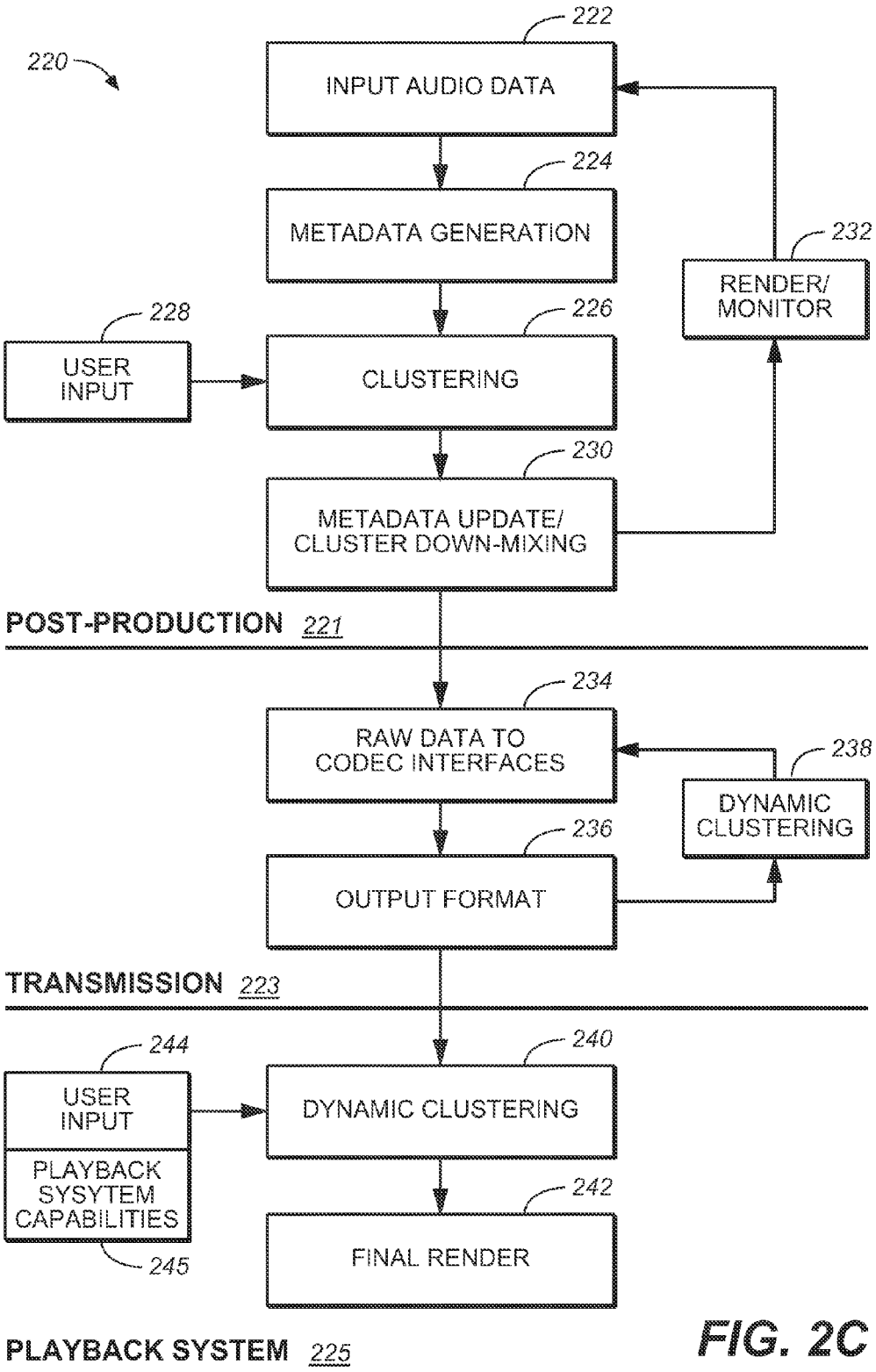
FIG. 2C illustrates clustering adaptive audio data in an overall adaptive audio rendering system, under an embodiment.

FIG. 2C illustrates clustering adaptive audio data in an overall adaptive audio rendering system, under an embodiment. The overall processing system 220 comprises three main stages of post-production 221, transmission (delivery/streaming) 223, and the playback system 225 (home/theater/studio). As shown in FIG. 2C, dynamic clustering processes to simplify the audio content by combining an original number of objects into a reduced number of objects or object clusters may be performed during one or any of these stages.

In the post-production stage 221, the input audio data 222, which could be cinema and/or home based adaptive audio content, is input to a metadata generation process 224. This process generates spatial metadata for the objects including: position, width, decorrelation, and rendering mode information, and well as content metadata including: content type, object boundaries and relative importance (energy/loudness). A clustering process 226 is then applied to the input data to reduce the overall number input objects into a smaller number of objects by combining certain objects together based on their spatial proximity, temporal proximity, or other characteristics. The clustering process 226 may be a dynamic clustering process that performs clustering as a constant or periodic process as the input data is processed in the system, and it may utilize user input 228 that specifies certain constraints such as target number of clusters, importance weighting to objects/clusters, filtering effects, and so on. The post-production stage may also include a cluster down-mixing step that provides certain processing of the clusters, such as mix, decorrelation, limiters, and so on. The post-production stage may include a render/monitor option 232 that allows the audio engineer to monitor or listen to the result of the clustering process, and modify the input data 222 or user input 228 if the results are not adequate.

The transmission stage 223 generally comprises components that perform raw data to codec interfacing 234, and packaging of the audio data into the appropriate output format 236 for delivery or streaming of the digital data using the appropriate codec (e.g., TrueHD, Dolby Digital+, etc.). In the transmission stage 223, a further dynamic clustering process 238 may also be applied to the objects that are produced during the post-production stage 221.

The playback system 225 receives the transmitted digital audio data and performs a final render step 242 for playback through the appropriate equipment (e.g., amplifiers plus speakers). During this stage an additional dynamic clustering process 240 may be applied using certain user input 244 and playback system (compute) capability 245 information to further group objects into clusters.

In an embodiment, the clustering processes 240 and 238 performed in either the transmission or playback stages may be limited clustering processes in that the amount of object clustering may be limited as compared to the post-production clustering process 226 in terms of number of clusters formed and/or the amount and type of information used to perform the clustering.

FIG. 3A illustrates the combination of audio signals and metadata for two objects to create a combined object, under an embodiment. As shown in diagram 300, a first object comprises an audio signal shown as waveform 302 along with metadata 312 for each defined period of time (e.g., 20 milliseconds). Thus, for example, if waveform 302 is a 60 millisecond audio clip, there are three different metadata instances for the first object, denoted MD1, MD2, and MD3. For the same time interval, a second object comprises an audio waveform 304 and three different corresponding metadata instances denoted MDa, MDb, and MDc. The clustering process 202 combines the two objects to create a combined object that comprises waveform 306 and associated metadata 316. In an embodiment, the original first and second waveforms 302 and 304 are combined by summing the waveforms to create combined waveform 306. Alternatively, the waveforms can be combined by other waveform combination methods depending on the system implementation. The metadata at each period for first and second objects are also combined to produce combined metadata 316 denoted MD1*a*, MD2*b*, and MD3*c*. The combination of metadata elements is performed according to defined algorithms or combinatorial functions, and can vary depending on system implementation. Different types of metadata can be combined in various different ways.

FIG. 3B is a table that illustrates example metadata definitions and combination methods for a clustering process, under an embodiment. As shown in column 352 of table 350, the metadata definitions include metadata types such as: object position, object width, audio content type, loudness, rendering modes, control signals, among other possible metadata types. The metadata definitions include elements that define certain values associated with each metadata type. Example metadata elements for each metadata type are listed in column 354 of table 350. When two or more objects are combined together in the clustering process 202, their respective metadata elements are combined through a defined combination scheme. Example combination schemes for each metadata type are listed in column 356 of table 350. As shown in FIG. 3B, the position and widths of two or more objects may each be combined through a weighted average to derive the position and width of the combined object. With respect to position, the geometric center of a centroid encompassing the clustered (constituent) objects can be used to represent the position of the replacement object. The combination of metadata may employ weights to determine the (relative) contribution of the metadata of the constituent objects. Such weights may be derived from the (partial) loudness of one or more objects and/or bed channels.

The loudness of the combined object may be derived by averaging or summing the loudness of the constituent objects. In an embodiment, the loudness metric of a signal represents the perceptual energy of the signal, which is a measure of the energy that is weighted based on frequency. Loudness is thus a spectrally weighted energy that corresponds to a listener's perception of the sound. In an alternative embodiment, instead of, or along with loudness, the process may use the pure energy (RMS energy) of the signal, or some other measure of signal energy as a factor in determining the importance of an object. In yet an alternative embodiment, the loudness of the combined object is derived from the partial loudness data of the clustered objects, in which the partial loudness represents the (relative) loudness of an object in the context of the complete set of objects and beds according to psychoacoustic principles. Thus, as shown in table 350, the loudness metadata type may be embodied as an absolute loudness, a partial loudness or a combined loudness metadata definition. Partial loudness (or relative importance) of an object can be used for clustering as an importance metric, or as means to selectively render objects if the rendering system does not have sufficient capabilities to render all objects individually.

Other metadata types may require other combination methods. For example, certain metadata cannot be combined through a logical or arithmetic operation, and thus a selection must be made. For example, in the case of rendering mode, which is either one mode or another, the rendering mode of the dominant object is assigned to be the rendering mode of the combined object. Other types of metadata, such as control signals and the like may be selected or combined depending on application and metadata characteristics.

With regard to content type, audio is generally classified into one of a number of defined content types, such as dialog, music, ambience, special effects, and so on. An object may change content type throughout its duration, but at any specific point in time it is generally only one type of content. The content type is thus expressed as a probability that the object is a particular type of content at any point in time. Thus, for example, a constant dialog object would be expressed as a one-hundred percent probability dialog object, while an object that transforms from dialog to music may be expressed as fifty percent dialog/fifty percent music. Clustering objects that have different content types could be performed by averaging their respective probabilities for each content type, selecting the content type probabilities for the most dominant object, or some other logical combination of content type measures. The content type may also be expressed as an n-dimensional vector (where n is the total number of different content types, e.g., four, in the case of dialog/music/ambience/effects). The content type of the clustered objects may then be derived by performing an appropriate vector operation. As shown in table 350, the content type metadata may be embodied as a combined content type metadata definition, where a combination of content types reflects the probability distributions that are combined (e.g., a vector of probabilities of music, speech, etc.).

With regard to classification of audio, in an embodiment, the process operates on a per time-frame basis to analyze the signal, identify features of the signal and compare the identified features to features of known classes in order to determine how well the features of the object match the features of a particular class. Based on how well the features match a particular class, the classifier can identify a probability of an object belonging to a particular class. For example, if at time t=T the features of an object match very well with dialog features, then the object would be classified as dialog with a high probability. If, at time=T+N, the features of an object match very well with music features, the object would be classified as music with a high probability. Finally, if at time T=T+2N the features of an object do not match particularly well with either dialog or music, the object might be classified as 50% music and 50% dialog.

The listing of metadata definitions in FIG. 3B is intended to be illustrative of certain example metadata definitions, and many other metadata elements are also possible, such as driver definitions (number, characteristics, position, projection angle), calibration information including room and speaker information, and any other appropriate metadata.

In an embodiment and with reference to FIG. 2A, the clustering process 202 is provided in a component or circuit that is separate from the encoder 204 and decoder 206 stages of the codec. The codec 204 may be configured to process both raw audio data 209 for compression using known compression techniques as well as processing adaptive audio data 201 that contains audio plus metadata definitions. In general, the clustering process is implemented as a pre-encoder and post-decoder process that clusters objects into groups before the encoder stage 204 and renders the clustered objects after the decoder stage 206. Alternatively, the clustering process 202 may be included as part of the encoder 204 stage as an integrated component.

Figure 4:
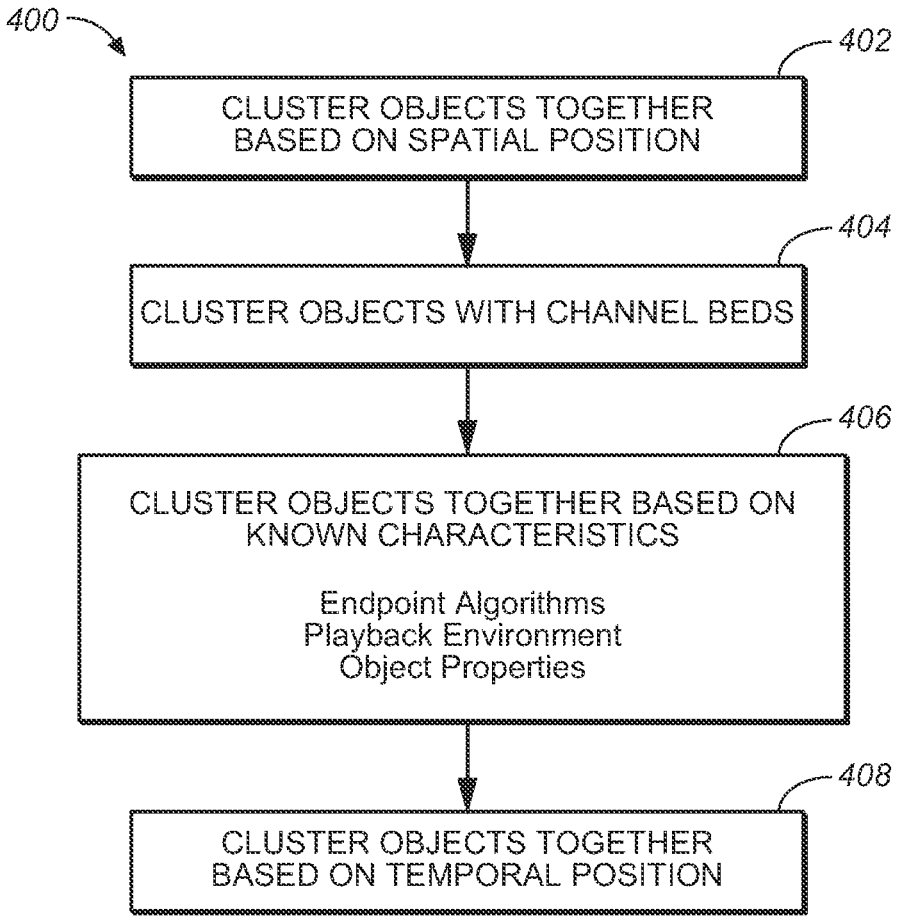
FIG. 4 is a block diagram of clustering schemes employed by a clustering process, under an embodiment.

FIG. 4 is a block diagram of clustering schemes employed by the clustering process of FIG. 2, under an embodiment. As shown in diagram 400, a first clustering scheme 402 focuses on the clustering individual objects with other objects to form one or more clusters of objects that can be transmitted with reduced information. This reduction can either be in the form of less audio or less metadata describing multiple objects. One example of clustering of objects is to group objects that are spatially related, i.e., to combine objects that are located in a similar spatial position, wherein the 'similarity' of the spatial position is defined by a maximum error threshold based on distortion due to shifting constituent objects to a position defined by the replacement cluster.

A second clustering scheme 404 determines when it is appropriate to combine audio objects that may be spatially diverse with channel beds that represent fixed spatial locations. An example of this type of clustering is when there is not enough available bandwidth to transmit an object that may be originally represented as traversing in a three dimensional space, and instead to mix the object into its projection onto the horizontal plane, which is where channel beds are typically represented. This allows one or more objects to be dynamically mixed into the static channels, thereby reducing the number of objects that need to be transmitted.

A third clustering scheme 406 uses prior knowledge of certain known system characteristics. For example, knowledge of the endpoint rendering algorithms and/or the reproduction devices in the playback system may be used to control the clustering process. For example, a typical home theater configuration relies on physical speakers located in fixed locations. These systems may also rely on speaker virtualization algorithms that compensate for the absence of some speakers in the room and use algorithms to give the listener virtual speakers that exist within the room. If information such as the spatial diversity of the speakers and the accuracy of virtualization algorithms is known, then it may be possible to send a reduced number of objects because the speaker configuration and virtualization algorithms can only provide a limited perceptual experience to a listener. In this case, sending a full bed plus object representation may be a waste of bandwidth, so some degree of clustering would be appropriate. Other types of known information could also be used in this clustering scheme, such as the content type of the object or objects to control clustering, or the width of an object or objects to control clustering. For this embodiment, the codec circuit 200 may be configured to adapt the output audio signals 207 based on the playback device. This feature allows a user or other process to define the number of grouped clusters 203, as well as the compression rate for the compressed audio 211. Since different transmission media and playback devices can have significantly different bandwidth capacity, a flexible compression scheme for both standard compression algorithms as well as object clustering can be advantageous. For example, if the input comprises a first number, e.g., 100 original objects, the clustering process may be configured to generate 20 combined groups 203 for Blu-ray systems or 10 objects for cell phone playback, and so on. The clustering process 202 may be recursively applied to generate incrementally fewer clustered groups 203 so that different sets of output signals 207 may be provided for different playback applications.

A fourth clustering scheme 408 comprises the use of temporal information to control the dynamic clustering and de-clustering of objects. In one embodiment, the clustering process is performed at regular intervals or periods (e.g., once every 10 milliseconds). Alternatively, other temporal events can be used, including techniques such as auditory scene analysis (ASA) and auditory event boundary detection to analyze and process the audio content to determine the optimum clustering configurations based on the duration of individual objects.

It should be noted that the schemes illustrated in diagram 400 can be performed by the clustering process 202 either as stand-alone acts or in combination with one or more other schemes. They may also be performed in any order relative to the other schemes, and no particular order is required for execution of the clustering process.

For the case where clustering is based on spatial position 402, the original objects are grouped into clusters for which a spatial centroid is dynamically constructed. The position of the centroid becomes the new position of the group. The audio signal for the group is a mix-down of all the original audio signals for each object belonging to the group. Each cluster can be seen as a new object that approximates its original contents but shares the same core attributes/data structures as the original input objects. As a result, each object cluster can be directly processed by the object renderer.

In an embodiment, the clustering process dynamically groups an original number of audio objects and/or bed channels into a target number of new equivalent objects and bed channels. In most practical applications, the target number is substantially lower than the original number, e.g., 100 original input tracks combined into 20 or fewer combined groups. These solutions apply to scenarios where both bed and object channels are available either as an input and/or an output to the clustering process. A first solution to support both objects and bed tracks is to process input bed tracks as objects with fixed pre-defined position in space. This allows the system to simplify a scene comprising, for example, both objects and beds into a target number of object tracks only. However, it might also be desirable to preserve a number of output bed tracks as part of the clustering process. Less important objects can then be rendered directly to the bed tracks as a pre-process, while the most important ones can be further clustered into a smaller target number of equivalent object tracks. If some of the resulting clusters have high distortion they can also be rendered to beds as a post-process, as this may result in a better approximation of the original content. This decision can be made on a time-varying basis, since the error/distortion is a time-varying function.

In an embodiment, the clustering process involves analyzing the audio content of every individual input track (object or bed) 201 as well as the attached metadata (e.g., the spatial position of the objects) to derive an equivalent number of output object/bed tracks that minimizes a given error metric. In a basic implementation, the error metric is based on the spatial distortion due to shifting the clustered objects and can further be weighted by a measure of the importance of each object over time. The importance of an object can encapsulate other characteristics of the object, such as loudness, content type, and other relevant factors. Alternatively, these other factors can form separate error metrics that can be combined with the spatial error metric.

Error Calculation

The clustering process essentially represents a type of lossy compression scheme that reduces the amount of data transmitted through the system, but that inherently introduces some amount of content degradation due to the combination of original objects into a fewer number of rendered objects. As stated above, the degradation due to the clustering of objects is quantified by an error metric. The greater the reduction of original objects into relatively few combined groups and/or the greater the amount of spatial collapsing of original objects into combined groups, the greater the error, in general. In an embodiment, the error metric used in the clustering process is expressed as shown in Equation 1:

$$E(s,c)[t]=\text{Importance_}s[t]*\text{dist}(s,c)[t] \quad (1)$$

As stated above, an object may be distributed over more than one cluster, rather than grouped into a single cluster with other objects. When an object signal x(s)[t] with index s is distributed over more than one cluster c with representative cluster audio signals y(c)[t] using amplitude gains g(s,c)[t] is as shown in Equation 2:

$$y(c)[t]=\text{sum_}s\ g(s,c)[t]*x(s)[t] \quad (2)$$

The error metric E(s,c)[t] for each cluster c can be weighted combination of the terms expressed in Equation 1 with weights that are a function of the amplitude gains g(s,c)[t] as shown in Equation 3:

$$E(s,c)[t]=\text{sum_}s(f(g(s,c)[t])*\text{Importance_}s[t]*\text{dist}(s,c)[t]) \quad (3)$$

In an embodiment, the clustering process supports objects with a width or spread parameter. Width is used for objects that are not rendered as pinpoint sources but rather as sounds with an apparent spatial extent. As the width parameter increases, the rendered sound becomes more spatially diffuse and consequently, its specific location becomes less relevant. It is thus advantageous to include width in the clustering distortion metric so that it favors more positional error as the width increases. The error expression E(s,c) can thus be modified to accommodate a width metric, as shown in Equation 4:

$$E(s,c)[t]=\text{Importance_}s[t]*(\alpha*(1-\text{Width_}s[t])*\text{dist}(s,c)[t]+(1\times\alpha)*\text{Width_}s[t]) \quad (4)$$

In the Equations 1 and 3 above, the importance factor s is the relative importance of the object, c the centroid of the cluster, and dist(s,c) the Euclidean three-dimensional distance between the object and the centroid of the cluster. All of these quantities are time-varying as denoted by the [t] term. A weighting term α can also be introduced to control the relative weight of size versus position of an object.

The importance function, Importance_s[t], can be a combination of signal-based metrics such as the loudness of the signal with higher level measure of how salient each object is relative to the rest of the mix. For example, a spectral similarity measure computed for each pair of input objects can further weight the loudness metric so that similar signals tend to be grouped together. For cinematic content as an example, it might also be desirable to give more importance to on-screen objects, in which case the importance can be further weighted by a directional dot-product term which is maximal for front-center objects and diminishes as the objects move off-screen.

When constructing the clusters, the importance function is temporally smoothed over a relatively long time window (e.g. 0.5 second) to ensure that the clustering is temporally consistent. In this context, including look-ahead or prior knowledge of object start and stop times can improve the accuracy of the clustering. In contrast, the equivalent spatial location of the cluster centroid can be adapted at a higher rate (10 to 40 milliseconds) using a higher rate estimate of the importance function. Sudden changes or increments in the importance metric (for example using a transient detector) may temporarily shorten the relatively long time window, or reset any analysis states in relation to the long time window.

As stated above, other information such as content type can be also included in the error metric as an additional importance weighting term. For instance, in a movie soundtrack dialog might be considered more important than music and sound effects. It would therefore be preferable to separate dialog in one or a few dialog-only clusters by increasing the relative importance of the corresponding objects. The relative importance of each object could also be provided or manually adjusted by a user. Similarly, only a specific subset of the original objects can be clustered or simplified if the user so desires, while the others would be preserved as individually rendered objects. The content type information could also be generated automatically using media intelligence techniques to classify audio content.

The error metric E(s,c) could be a function of several error components based on the combined metadata elements. Thus, other information besides distance could factor in the clustering error. For example, like objects may be clustered together rather than disparate objects, based on object type, such as dialog, music, effects, and so on. Combining objects of different types that are incompatible can result in distortion or degradation of the output sound. Error could also be introduced due to inappropriate or less than optimum rendering modes for one or more of the clustered objects. Likewise, certain control signals for specific objects may be disregarded or compromised for clustered objects. An overall error term may thus be defined that represents the sum of errors for each metadata element that is combined when an object is clustered. An example expression of overall error is shown in Equation 5:

$$E_{overall}[t]=\Sigma E_{MDn} \quad (5)$$

In Equation 5, MDn represents specific metadata elements of N metadata elements that are combined for each object that is merged in a cluster, and $E_{MDn}$ represents the error associated with combining that metadata value with corresponding metadata values for other objects in a cluster. The error value may be expressed as a percentage value for metadata values that are averaged (e.g., position/loudness), or as a binary 0 percent or 100 percent value for metadata values that are selected as one value or another (e.g., rendering mode), or any other appropriate error metric. For the metadata elements illustrated in FIG. 3B, the overall error could be expressed as shown in Equation 6:

$$E_{overall}[t]=E_{spatial}+E_{loudness}+E_{rendering}+E_{control} \quad (6)$$

The different error components other than spatial error can be used as criteria for the clustering and de-clustering of objects. For example, loudness may be used to control the clustering behavior. Specific loudness is a perceptual measure of loudness based on psychoacoustic principles. By measuring the specific loudness of different objects, the perceived loudness of an object may guide whether it is clustered or not. For example, a loud object is likely to be more apparent to a listener if it's spatial trajectory is modified, while the opposite is generally true for quieter objects. Therefore, specific loudness could be used as a weighting factor in addition to spatial error to control the clustering of objects. Another example is object type, wherein some types of objects may be more perceptible if their spatial organization is modified. For example, humans are very sensitive to speech signals and these types of objects may need to be treated differently than other objects such as noise-like or ambient effects for which spatial perception is less acute. Therefore, object type (such as speech, effects, ambience, etc.) could be used as a weighting factor in addition to spatial error to control the clustering of objects.

The clustering process 202 thus combines objects into clusters based on certain characteristics of the objects and a defined amount of error that cannot be exceeded. As shown in FIG. 3A, the clustering process 202 dynamically recomputes the object groups 203 to constantly build object groups at different or periodic time intervals to optimize object grouping on a temporal basis. The substitute or combined object group comprises a new metadata set that represents a combination of the metadata of the constituent objects and an audio signal that represents a summation of the constituent object audio signals. The example shown in FIG. 3A illustrates the case where the combined object 306 is derived by combining original objects 302 and 304 for a particular point in time. At a later time, the combined object could be derived by combining one or more other or different original objects, depending upon the dynamic processing performed by the clustering process.

Figure 5A:
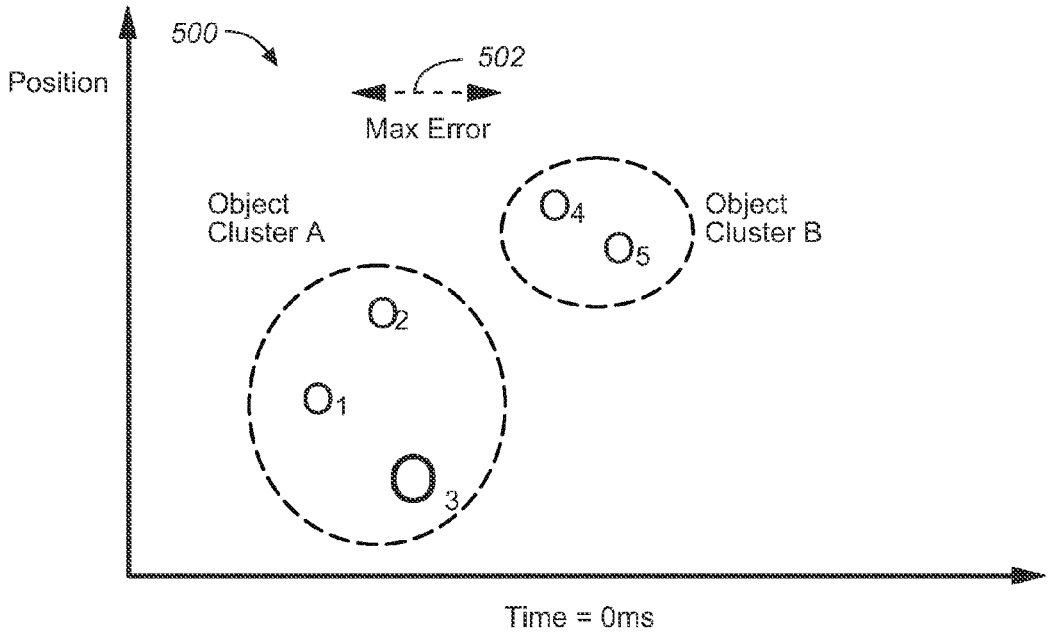
FIGS. 5A and 5B illustrate the grouping of objects into clusters during periodic time intervals, under an embodiment.
Figure 5B:
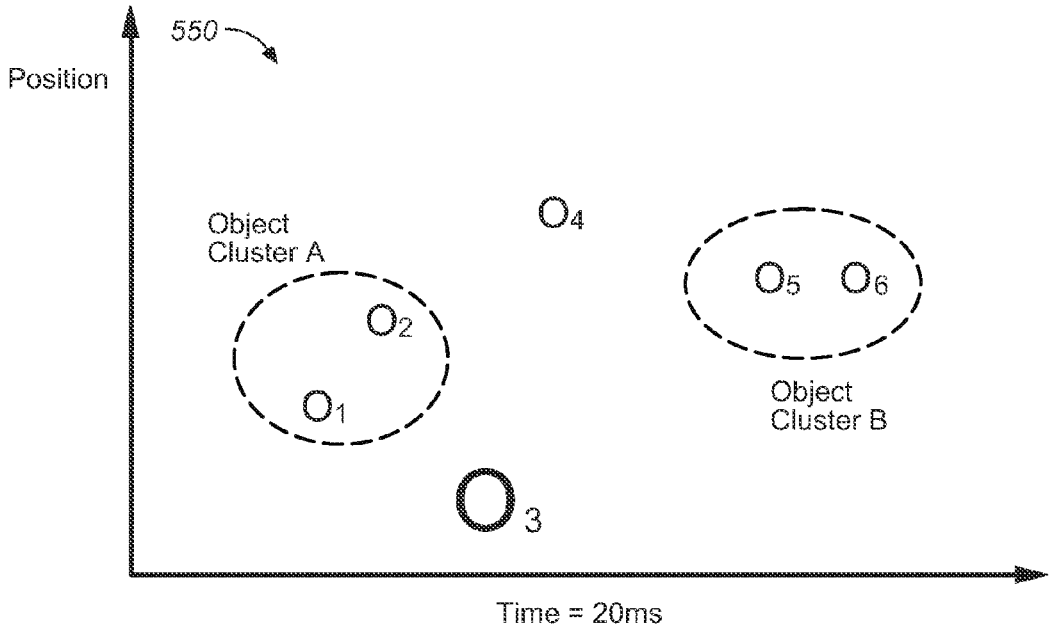

In one embodiment, the clustering process analyzes the objects and performs clustering at regular periodic intervals, such as once every 10 milliseconds, or any other appropriate time period. FIGS. 5A to 5B illustrate the grouping of objects into clusters during periodic time intervals, under an embodiment. As shown in diagram 500, which plots the position or location of objects at particular points in time. Various objects can exist in different locations at any one point in time, and the objects can be of different widths, as shown in FIG. 5A, where object $O_3$ is shown to have larger width than the other objects. The clustering process analyzes the objects to form groups of objects that are spatially close enough together relative to a defined maximum error threshold value. Objects that separated from one another within a distance defined by the error threshold 502 are eligible to be clustered together, thus objects $O_1$ to $O_3$ can be clustered together within an object cluster A, and objects $O_4$ and $O_5$ can be clustered together in a different object cluster B. These clusters are formed based on the relative positions of the objects at a certain time (e.g., T=0 milliseconds). In the next time period, the objects may have moved or changed in terms of one or more of the metadata characteristics, in which case the object clusters may be re-defined. Each object cluster replaces the constituent objects with a different waveform and metadata set. Thus, object cluster A comprises a waveform and metadata set that is rendered in place of the individual waveforms and metadata for each of objects $O_1$ to $O_3$.

FIG. 5B illustrates a different clustering of the objects at a next time period (e.g., Time=10 milliseconds). In the example of diagram 550, object $O_5$ has moved away from object $O_4$ and within a close proximity to another object, object $O_6$. In this case, object cluster B now comprises objects $O_5$ to $O_6$ and object $O_4$ becomes de-clustered and is rendered as a standalone object. Other factors may also cause objects to be de-clustered or to change clusters. For example, the width or loudness (or other parameter) of an object may become large or different enough from its neighbors so that it should no longer be clustered with them. Thus, as shown in FIG. 5B, object $O_3$ may become wide enough so that it is declustered from object cluster A and also rendered alone. It should be noted that the horizontal axis in FIGS. 5A-5B does not represent time, but instead is used as a dimension with which to spatially distribute multiple objects for visual organization and sake of discussion. The entire top of the diagram(s) represents a moment or snapshot at time t of all of the objects and how they are clustered.

Figure 6A:
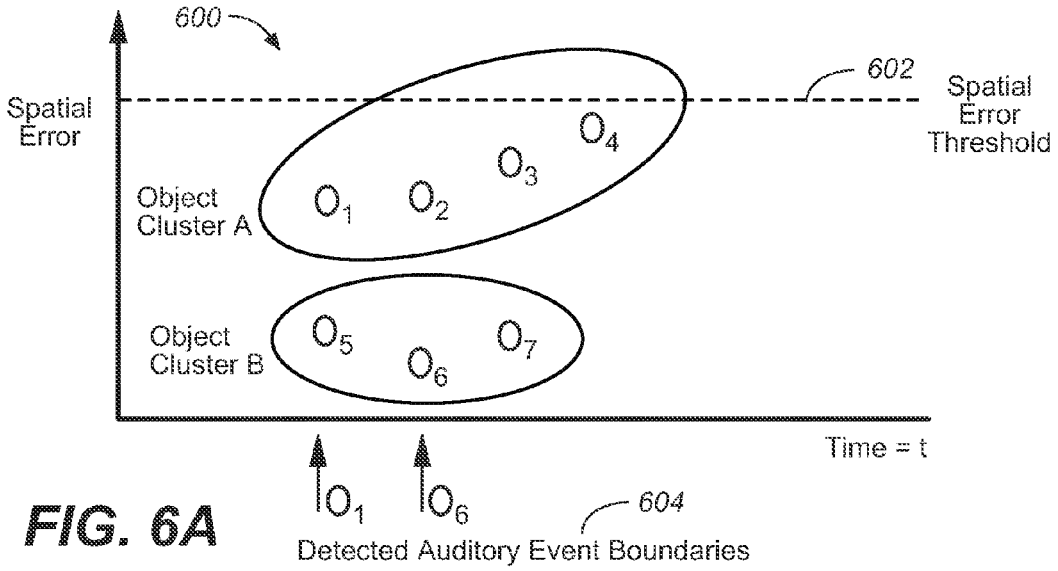
FIGS. 6A, 6B, and 6C illustrate the grouping of objects into clusters in relation to defined object boundaries and error thresholds, under an embodiment.
Figure 6B:
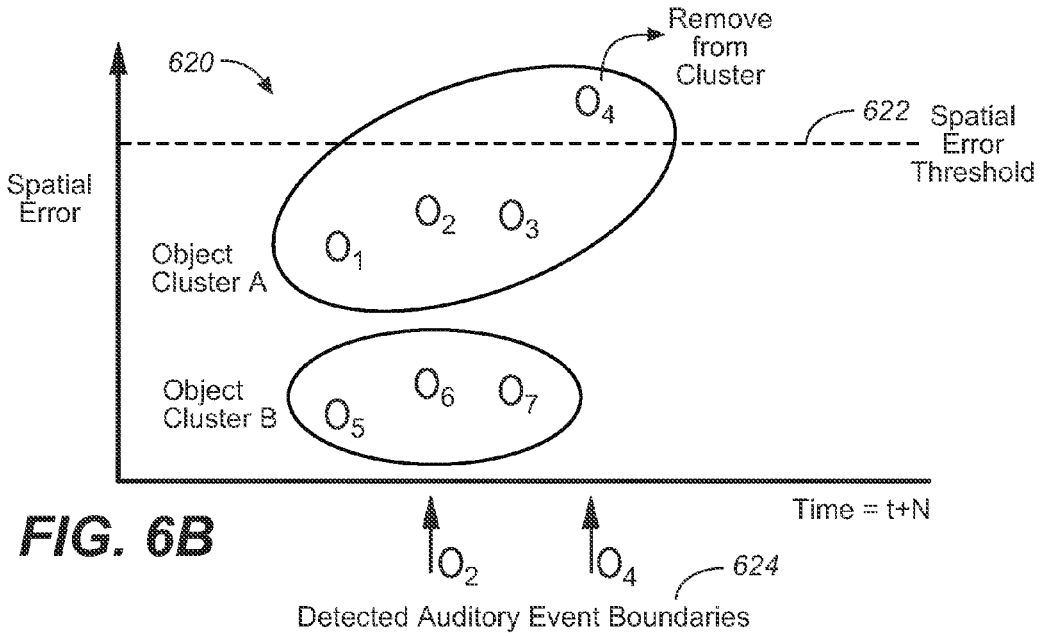
Figure 6C:
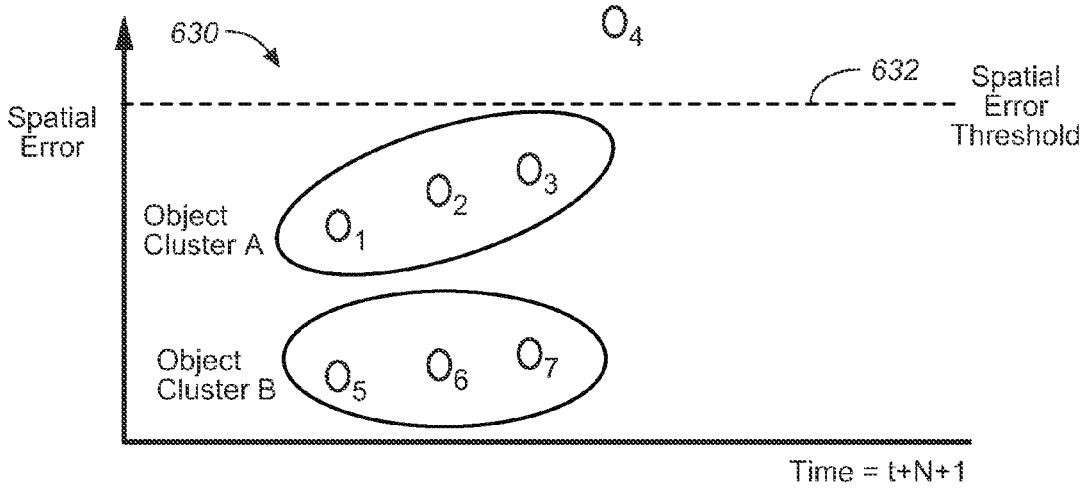

Instead of performing clustering every time period as shown in FIGS. 5A to 5B, the clustering process may cluster objects based on a trigger condition or event associated with the objects. One such trigger condition is the start and stop times for each object. FIGS. 6A to 6C illustrate the grouping of objects into clusters in relation to defined object boundaries and error thresholds, under an embodiment. As a threshold step, each object must be defined within a specific time period. Various different methods may be used to define objects in time. In one embodiment, object start/stop temporal information can be used to define objects for the clustering process. This method utilizes explicit time-based boundary information that defines the start point and stop point of an audio object. Alternatively, an auditory scene analysis technique can be used to identify the event boundaries that define an object in time. Such a technique is described in U.S. Pat. No. 7,711,123, which is hereby incorporated by reference, and which is attached hereto as Exhibit B. The detected auditory scene event boundaries are perceptually relevant moments in time where there is a perceptual change in the audio that can be used to provide "perceptual masking" within the audio where changes can be made to the audio that are not heard by a listener.

FIGS. 6A to 6C illustrate the use of auditory scene analysis and audio event detection, or other similar methods, to control the clustering of audio objects using a clustering process, under an embodiment. The examples of these figures outlines the use of detected auditory events to define clusters and remove an audio object from an object cluster based on a defined error threshold. FIG. 6A is a diagram 600 that shows the creation of object clusters in a plot of spatial error at a particular time (t). Two audio object clusters denoted cluster A and cluster B such that object cluster A is comprised of four audio objects $O_1$ through $O_4$ and object cluster B is comprised of three audio objects $O_5$ through $O_7$. The vertical dimension of diagram 600 indicates the spatial error, which is a measure of how dissimilar a spatial object is from the rest of the clustered objects and can be used to remove the object from the cluster. Also shown in diagram 600 are detected auditory event boundaries 604 for the various individual objects $O_1$ through $O_7$. As each object represents an audio waveform, it is possible at any given moment in time for an object to have a detected auditory event boundary 604. As shown in the diagram 600, at time=t, objects $O_1$ and $O_6$ have detected auditory event boundaries in each of their audio signals. It should be noted that the horizontal axis in FIGS. 6A-6C does not represent time, but instead is used as a dimension with which to spatially distribute multiple objects for visual organization and sake of discussion. The entire top of the diagram represents a moment or snapshot at time t of all of the objects and how they are clustered.

As shown in FIG. 6A, a spatial error threshold value 602. This value represents the amount of error that must be exceeded to remove an object from a cluster. That is, if an object is separated from other objects in a potential cluster by an amount that exceeds this error threshold 602, that object is not included in the cluster. Thus, for the example of FIG. 6A, none of the individual objects have a spatial error that exceeds the spatial error threshold that is indicated by threshold value 602, and therefore no de-clustering should take place.

FIG. 6B illustrates the clustering example of FIG. 6A at a time=t+N, which is some finite amount of time after t where the spatial error of each of the objects has changed slightly for objects $O_1$ through $O_3$ and $O_5$ through $O_7$. In this example, object $O_4$ has a spatial error that exceeds the predefined spatial error threshold 622. It should be noted that at time=t+N auditory event boundaries have been detected for objects $O_2$ and $O_4$ which indicates that at time=t+N the perceptual masking created by the event boundary in the waveform for $O_4$ allows for the object to be removed from the cluster. Note that object $O_4$ may have exceeded the spatial error threshold between t<time<t+N, but because an auditory event was not detected the object remained in object cluster A. In this case, the clustering process will cause object $O_4$ to be removed (de-clustered) from cluster A. As shown in FIG. 6C, the removal of object $O_4$ from object cluster A results in the new object clustering organization at time=t+N+1. At this time object $O_4$ may reside as a single object that is rendered or it may be integrated into another object cluster if a suitable cluster is available.

Figure 7:
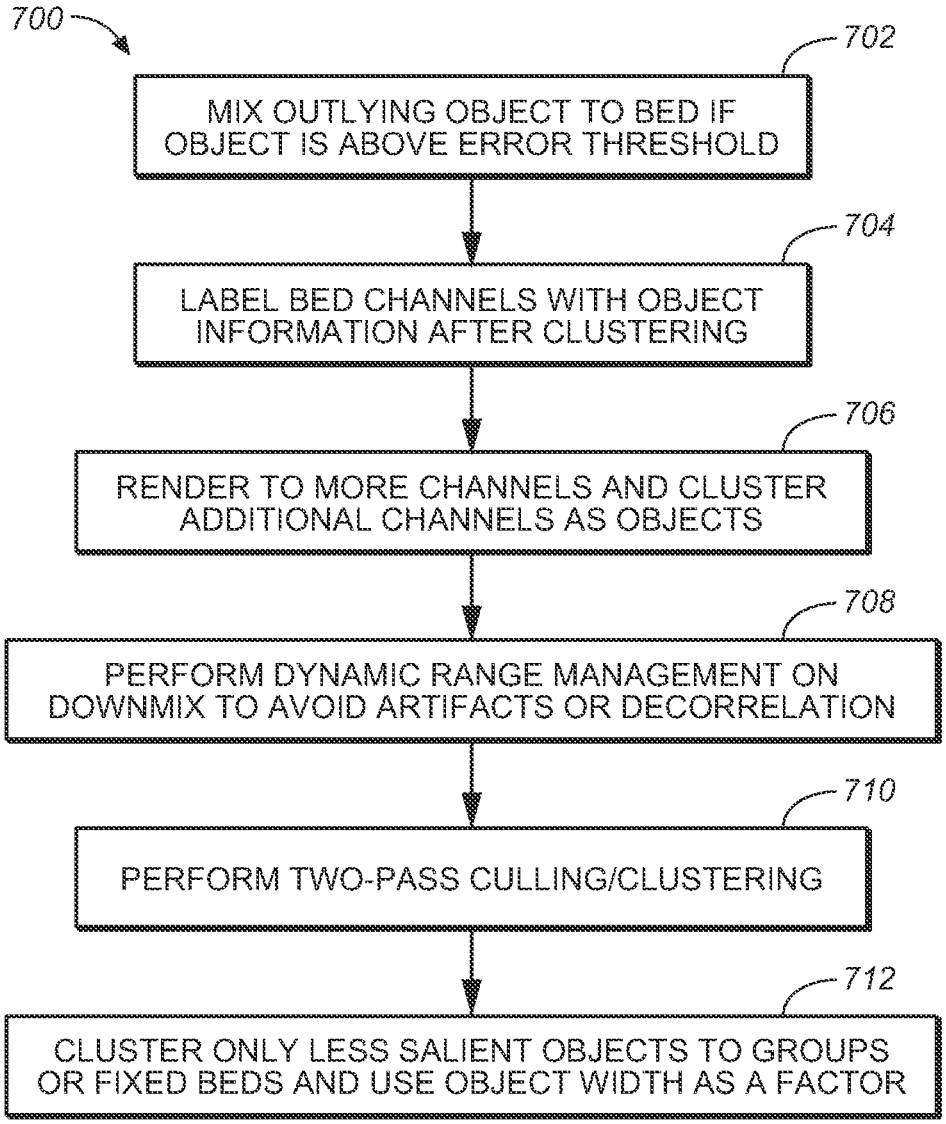
FIG. 7 is a flowchart that illustrates a method of clustering objects and beds, under an embodiment.

In an adaptive audio system, certain objects may be defined as fixed objects, such as channel beds that are associated with specific speaker feeds. In an embodiment, the clustering process accounts for bed plus dynamic object interaction, such that when an object creates too much error when being grouped with a clustered object (e.g., it is an outlying object), it is instead mixed to a bed. FIG. 7 is a flowchart that illustrates a method of clustering objects and beds, under an embodiment. The method 700 shown in FIG. 7, it is assumed that beds are defined as fixed position objects. Outlying objects are then clustered (mixed) with one or more appropriate beds if the object is above an error threshold for clustering with other objects, act 702. The bed channel(s) are then labeled with the object information after clustering, act 704. The process then renders the audio to more channels and clusters additional channels as objects, act 706, and performs dynamic range management on downmix or smart downmix to avoid artifacts/decorrelation, phase distortion, and the like, act 708. In act 710 the process performs a two-pass culling/clustering process. In an embodiment, this involves keeping the N most salient objects separate, and clustering the remaining objects. Thus, in act 712, the process clusters only less salient objects to groups or fixed beds. Fixed beds could be added to a moving object or clustered object, which may be more suitable for particular endpoint devices, such as headphone virtualization. The object width may be used as a characteristic of how many and which objects are clustered together and where they will be spatially rendered following clustering.

In an embodiment, object signal-based saliency is the difference between the average spectrum of the mix and spectrum of each object and saliency metadata elements may be added to objects/clusters. The relative loudness is a percentage of the energy/loudness contributed by each object to the final mix. A relative loudness metadata element can also be added to objects/clusters. The process can then sort by saliency to cull masked sources and/or preserve most important sources. Clusters can be simplified by further attenuating low importance/low saliency sources.

The clustering process is generally used as a means for data rate reduction prior to audio coding. In an embodiment, object clustering/grouping is used during decoding based on the end-point device rendering capabilities. Various different end-point devices may be used in conjunction with a rendering system that employs a clustering process as described herein, such as anything from full cinema playback environment, home theater system, gaming system and personal portable device, and headphone system. Thus, the same clustering techniques may be utilized while decoding the objects and beds in a device, such as a Blu-ray player, prior to rendering in order that the capabilities of the renderer will not be exceeded. In general, rendering of the object and bed audio format requires that each object be rendered to some set of channels associated with the renderer as a function of each object's spatial information. The computational cost of this rendering scales with the number of objects, and therefore any rendering device will have some maximum number of objects it can render that is a function of its computational capabilities. A high-end renderer, such as an AVR, may contain an advanced processor that can render a large number of objects simultaneously. A less expensive device, such as a home theater in a box (HTIB) or a soundbar, may be able to render fewer objects due to a more limited processor. It is therefore advantageous for the renderer to communicate to the decoder the maximum number of objects and beds that it can accept. If this number is smaller than the number of objects and beds contained in the decoded audio, then the decoder may apply clustering of object and beds prior to transmission to the renderer so as to reduce the total to the communicated maximum. This communication of capabilities may occur between separate decoding and rendering software components within a single device, such as an HTIB containing an internal Blu-ray player, or over a communications link, such as HDMI, between two separate devices, such as a stand-alone Blu-ray player and an AVR. The metadata associated with objects and clusters may indicate or provide information as to optimally reduce the number of clusters by the renderer, by enumerating the order of importance, signaling the (relative) importance of clusters, or specify which clusters should be combined sequentially to reduce the overall number of clusters that should be rendered. This is described later with reference to FIG. 15.

In some embodiments, the clustering process may be performed in the decoder stage 206 with no additional information other than that inherent to each object. However, the computational cost of this clustering may be equal to or greater than the rendering cost that it is attempting to save. A more computationally efficient embodiment involves computing a hierarchical clustering scheme at the encode side 204, where computational resources may be much greater, and sending the metadata along with the encoded bitstream which instructs the decoder how to cluster objects and beds into progressively smaller numbers. For example, the metadata may state: first merge object 2 with object 10. Second merge the resulting object with object 5, and so on.

In an embodiment, objects may have one or more time varying labels associated with them to denote certain properties of the audio contained in the object track. As described above, an object may be categorized into one of several discreet content types, such as dialog, music, effects, background, etc., and these types may be used to help guide the clustering. At the same time, these categories may also be useful during the rendering process. For example, a dialog enhancement algorithm might be applied only to objects labeled as dialog. When objects are clustered however, the cluster might be comprised of objects with different labels. In order to label the cluster, several techniques may be employed. A single label for the cluster may be chosen, for example, by selecting the label of the object with the largest amount of energy. This selection may also be time varying, where a single label is chosen at regular intervals of time during the cluster's duration, and at each particular interval the label is chosen from the object with the largest energy within that particular interval. In some cases, a single label may not be sufficient, and a new, combined label may be generated. For example, at regular intervals, the labels of all objects contributing to the cluster during that interval may be associated with the cluster. Alternatively, a weight may be associated with each of these contributing labels. For example, the weight may be set equal to the percentage of overall energy belonging to that particular type: for example, 50% dialog, 30% music, and 20% effects. Such labeling may then be used by then renderer in a more flexible manner. For example, a dialog enhancement algorithm may only be applied to clustered object tracks containing at least 50% dialog.

Once the clusters that combine different objects have been defined, equivalent audio data must be generated for each cluster. In an embodiment, the combined audio data is simply the sum of the original audio content for each original object in the cluster, as shown in FIG. 3A. However, this simple technique may lead to digital clipping. To mitigate this possibility, several different techniques can be employed. For example, if the renderer supports floating audio data, then high dynamic range information can be stored and passed on to the renderer to be used in a later processing stage. If only limited dynamic range is available, then it is desirable to either limit the resulting signal or attenuate it by some amount, which can be either fixed or dynamic. In this latter case, the attenuation coefficient will be carried into the object data as a dynamic gain. In some cases, direct summation of the constituent signals can lead to comb-filtering artifacts. This problem can be mitigated by applying decorrelation filters, or similar processes, prior to summation. Another method to mitigate timbre changes due to downmixing is to use the phase alignment of object signals before summation. Yet another method to resolve comb-filtering or timbre changes is to re-enforce amplitude or power complimentary summation by applying frequency-dependent weights to the summed audio signal, in response to the spectrum of the summed signal and the spectra of the individual object signals.

When generating a downmix, the process can further reduce the bit depth of a cluster to increase the compression of data. This can be performed through a noise-shaping, or similar process. A bit depth reduction generates a cluster that has a fewer number of bits than the constituent objects. For example, one or more 24-bit objects can be grouped into a cluster that is represented as 16 or 20-bits. Different bit reduction schemes may be used for different clusters and objects depending on the cluster importance or energy, or other factors. Additionally, when generating a downmix, the resulting downmix signal may have sample values beyond the acceptable range that can be represented by digital representations with a fixed number of bits. In such case, the downmix signal may be limited using a peak limiter, or (temporarily) attenuated by a certain amount to prevent out-of-range sample values. The amount of attenuation applied may be included in the cluster metadata so that it can be un-done (or inverted) during rendering, coding, or other subsequent process.

In an embodiment, the clustering process may employ a pointer mechanism whereby the metadata includes pointers to specific audio waveforms that are stored in a database or other storage. Clustering of objects is performed by pointing to appropriate waveforms by combined metadata elements. Such as system can be implemented in an archive system that generates a precomputed database of audio content, transmits the audio waveforms from the coder and decoder stages and then constructs the clusters in the decode stage using pointers to specific audio waveforms for the clustered objects. This type of mechanism can be used in a system that facilitates packaging of object-based audio for different end-point devices.

The clustering process can also be adapted to allow for re-clustering on the end-point client device. Generally substitute clusters replace original objects, however, for this embodiment, the clustering process also sends error information associated with each object to allow the client to determine whether or not an object is an individually rendered object or a clustered object. If the error value is 0, then it can be deduced that there was no clustering. If, however, the error value equals some amount, then it can be deduced that the object is the result of some clustering. Rendering decisions at the client can then be based on the amount of error. In general, the clustering process is run as an off-line process. Alternatively, it may be run as a live process as the content is created. For this embodiment, the clustering component may be implemented as a tool or application that may be provided as part of the content creation and/or rendering system.

Perceptual-Based Clustering

In an embodiment, a clustering method is configured to combine object and/or bed channels in constrained conditions, e.g., in which the input objects cannot be clustered without violating a spatial error criterion, due to the large number of objects and/or their spatially sparse distribution. In such conditions, the clustering process is not only controlled by spatial proximity (derived from metadata), but is augmented by perceptual criteria derived the corresponding audio signals. More specifically, objects with a high (perceived) importance in the content will be favored over objects with low importance in terms of minimizing spatial errors. Examples of quantifying importance include, but are not limited to partial loudness and semantics (content type).

Figure 8:
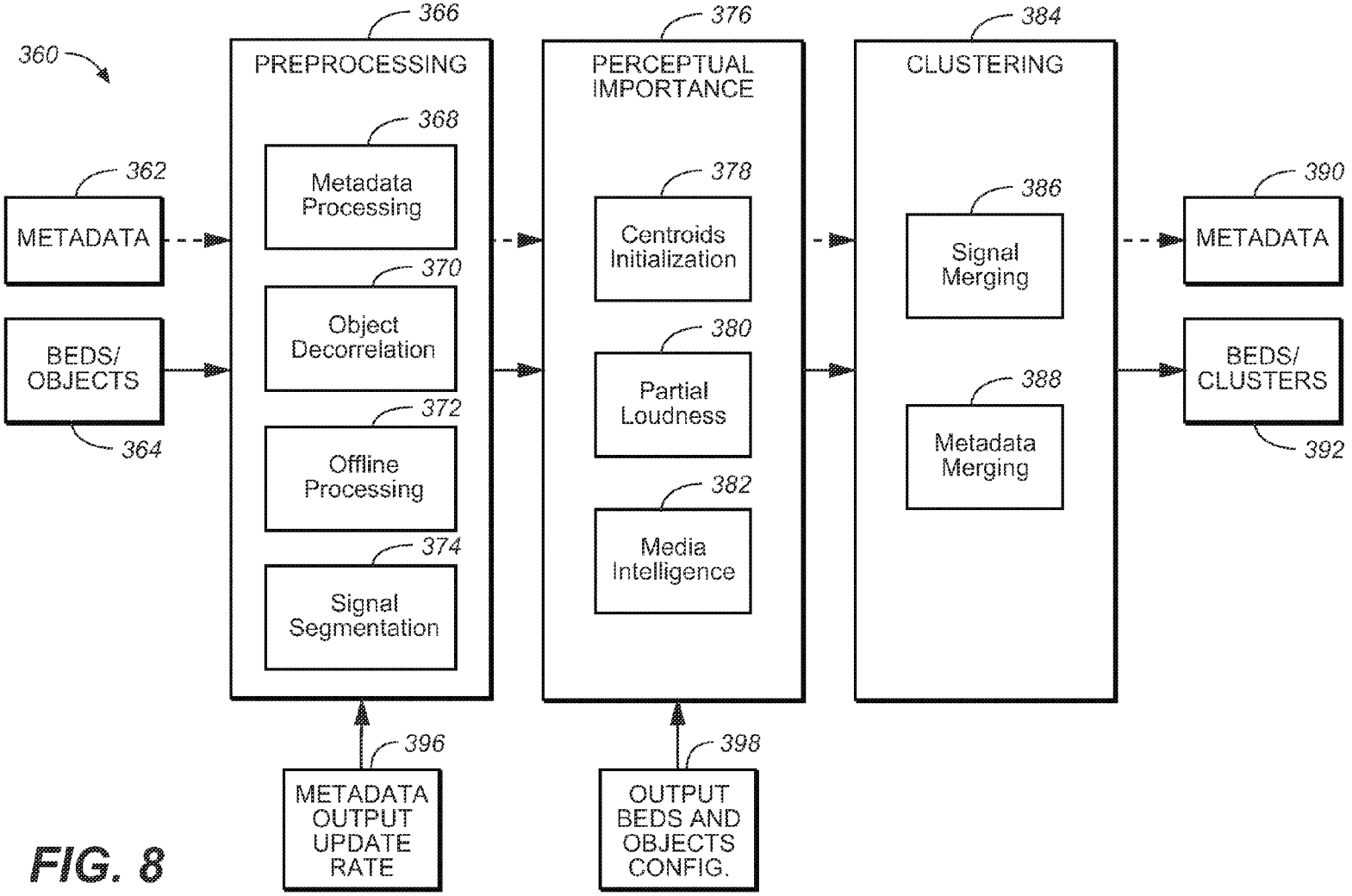
FIG. 8 illustrates a system for clustering objects and bed channels into clusters based on perceptual importance in addition to spatial proximity, under an embodiment.

FIG. 8 illustrates a system for clustering objects and bed channels into clusters based on perceptual importance in addition to spatial proximity, under an embodiment. As shown in FIG. 8, system 360 comprises a pre-processing unit 366, a perceptual importance component 376, and a clustering component 384. Channel beds and/or objects 364 along with associated metadata 362 are input to the preprocessing unit 366 and processed to determine their relative perceptual importance and then clustered with other beds/objects to produce output beds and/or clusters of objects (which may consist of single objects or sets of objects) 392 along with the associated metadata 390 for these clusters. In an example embodiment or implementation, the input may consist of 11.1 bed channels and 128 or more audio objects, and the output may comprise a set of beds and clusters that comprise on the order of 11-15 signals in total with associated metadata for each cluster, though embodiments are not so limited. The metadata may include information that specifies object position, size, zone masks, decorrelator flags, snap flag, and so on.

The preprocessing unit 366 may include individual functional components such as a metadata processor 368, an object decorrelation unit 370, an offline processing unit 372, and a signal segmentation unit 374, among other components. External data, such as a metadata output update rate 396 may be provided to the preprocessor 366. The perceptual importance component 376 comprises a centroid initialization component 378, a partial loudness component 380, and a media intelligence unit 382, among other components. External data, such as an output beds and objects configuration data 398 may be provided to the perceptual importance component 376. The clustering component 384 comprises signal merging 386 and metadata merging 388 components that form the clustered beds/objects to produce the metadata 390 and clusters 392 for the combined bed channels and objects.

With regard to partial loudness, the perceived loudness of an object is usually reduced in the context of other objects. For example, objects may be (partially) masked by other objects and/or bed channels present in the scene. In an embodiment, objects with a high partial loudness are favored over objects with a low partial loudness in terms of spatial error minimization. Thus, relatively unmasked (i.e., perceptually louder) objects are less likely to be clustered while relatively masked objects are more likely to be clustered. This process preferably includes spatial aspects of masking, e.g., the release from masking if a masked object and a masking object have different spatial attributes. In other words, the loudness-based importance of a certain object of interest is higher when that object is spatially separated from other objects compared to when other objects are in the direct vicinity of the object of interest.

In an embodiment, the partial loudness of an object comprises the specific loudness extended with spatial unmasking phenomena. A binaural release from masking is introduced to represent the amount of masking based on the spatial distance between two objects, as provided in the equation below.

$$N'_k(b)=(A+\Sigma E_m(b))^{\alpha}+(A+\Sigma E_m(b)(1-f(k,m)))^{\alpha}$$

In the above equation, the first summation is performed over all m, and the second summation is performed for all $m \neq k$. The term $E_m(b)$ represents the excitation of object m, the term A reflects the absolute hearing threshold, and the term $(1-f(k, m))$ represents the release from masking. Further details regarding this equation are provided in the discussion below.

With regard to content semantics or audio type, dialogue is often considered to be more important (or draws more attention) than background music, ambience, effects, or other types of content. The importance of an object is therefore dependent on its (signal) content, and relatively unimportant objects are more likely to be clustered than important objects.

The perceptual importance of an object can be derived by combining the perceived loudness and content importance of the objects. For example, in an embodiment, content importance can be derived based on a dialog confidence score, and a gain value (in dB) can be estimated based on this derived content importance. The loudness or excitation of the object can then be modified by the estimated loudness, with the modified loudness representing the final perceptual importance of the object.

Figure 9:
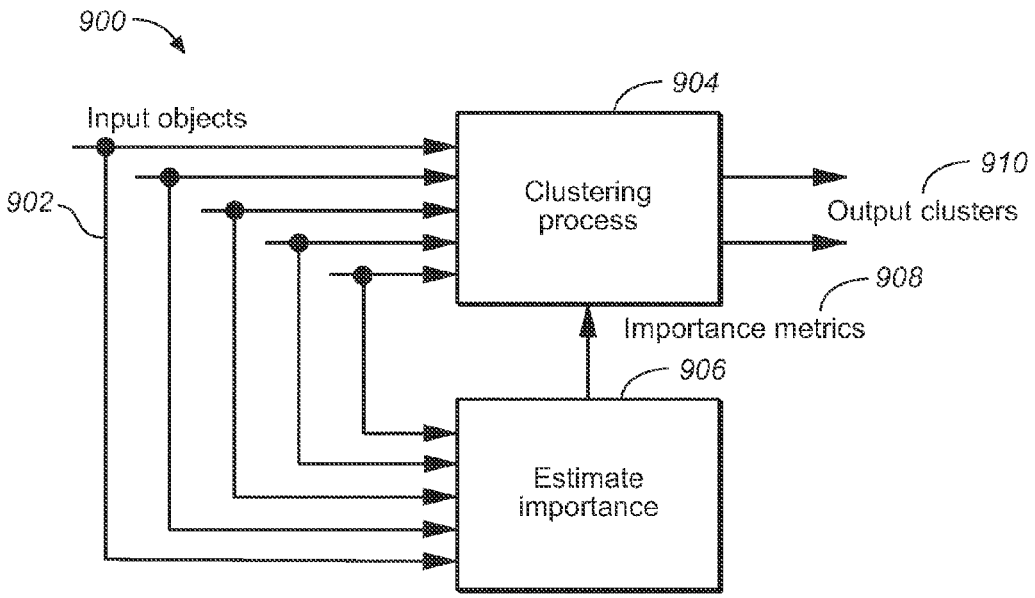
FIG. 9 illustrates components of a process flow for clustering audio objects into output clusters, under an embodiment.

FIG. 9 illustrates functional components of an object clustering process using perceptual importance, under an embodiment. As shown in diagram 900, input audio objects 902 are combined into output clusters 910 through a clustering process 904. The clustering process 904 clusters the objects 902, at least in part, based on importance metrics 908 that are generated from the object signals and optionally their parametric object descriptions. These object signals and parametric object descriptions are input to an estimate importance 906 function, which generates the importance metrics 908 for use by the clustering process 904. The output clusters 910 constitute a more compact representation (e.g., a smaller number of audio channels) than the original input object configuration, thus allowing for reduced storage and transmission requirements; and reduced computational and memory requirements for reproduction of the content, especially on consumer-domain devices with limited processing capabilities and/or that operate on batteries.

In an embodiment, the estimate importance 906 and clustering 904 processes are performed as a function of time. For this embodiment, the audio signals of the input objects 900 are segmented into individual frames that are subjected to certain analysis components. Such segmentation may be applied on time-domain waveforms, but also using filter banks, or any other transform domain. The estimate importance function 906 operates on one or more characteristics of the input audio objects 902 including content type and partial loudness.

Figure 11:
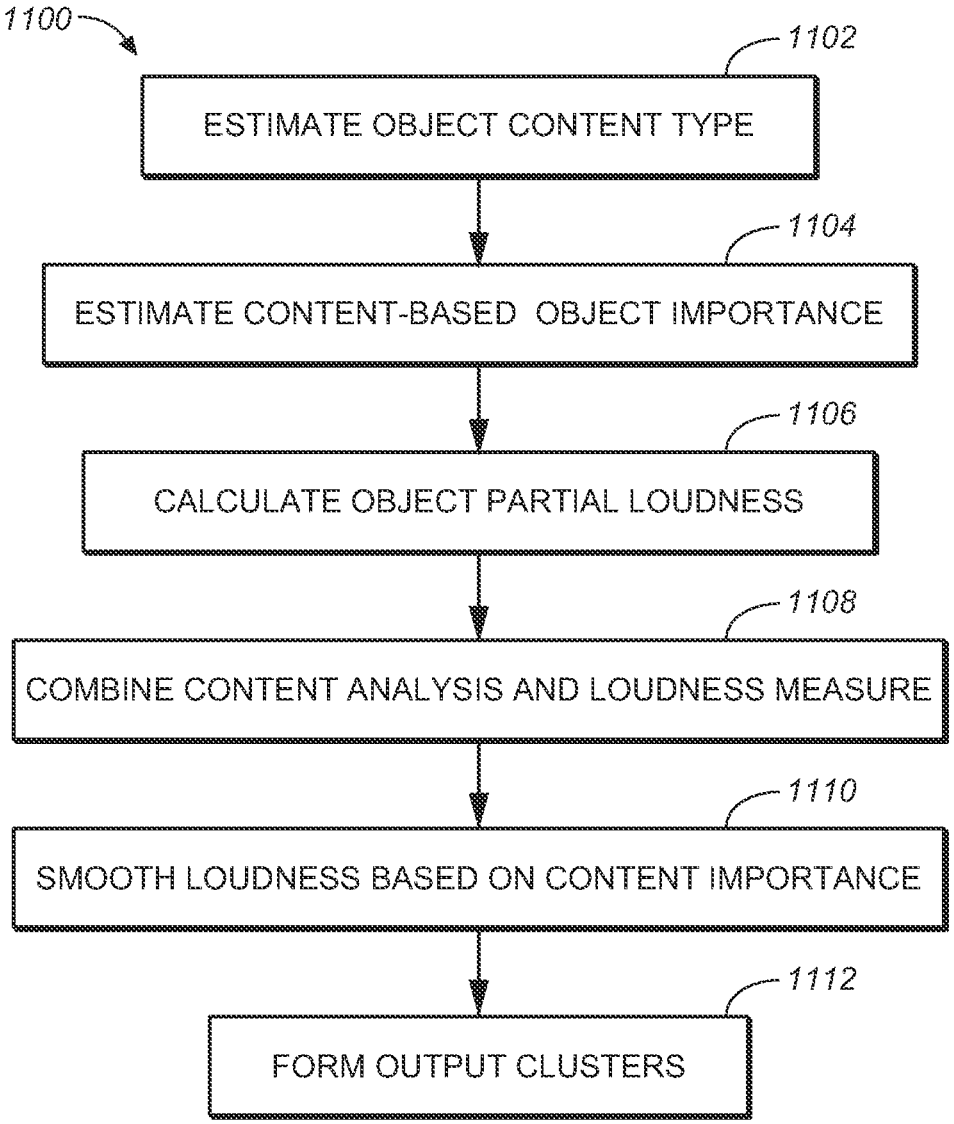
FIG. 11 is a flowchart illustrating an overall method of processing audio objects based on the perceptual factors of content type and loudness, under an embodiment.

FIG. 11 is a flowchart illustrating an overall method of processing audio objects based on the perceptual factors of content type and loudness, under an embodiment. The overall acts of method 1100 include estimating the content type of an input object (1102), and then estimating the importance of the content-based object (1104). The partial loudness of the object is calculated as shown in block 1106. The partial loudness can be computed in parallel with the content classification, or even before or after the content classification, depending on system configuration. The loudness measure and content analysis can then be combined (1108) to derive an overall importance based on loudness and content. This may be done by modifying the calculated loudness of an object by the probability of that object being perceptually important due to content. Once the combined object importance is determined, the object can be clustered with other objects or left unclustered depending on certain clustering processes. To prevent undue clustering and unclustering of objects based on loudness, a smoothing operation may be used to smooth the loudness based on content importance (1110). With regard to loudness smoothing, a time constant is selected based on the relative importance of an object. For important objects, a large time constant that smoothes slowly can be selected so that important objects can be consistently selected as the cluster centroid. An adaptive time constant may also be used based on the content importance. The smoothed loudness and content importance of the object is then used to form the appropriate output clusters (1112). Aspects of each of the main process acts illustrated in method 600 are described in greater detail below. It should be noted that depending on system constraints and application requirements, certain acts of process 1100 may be omitted, if necessary, such as in a basic system that perhaps bases perceptual importance on only one of content type or partial loudness, or one that does not require loudness smoothing.

With regard to estimating the object content type (1102), the content type (e.g., dialog, music, and sound effects) provides critical information to indicate the importance of an audio object. For example, dialog is usually the most important component in a movie since it conveys the story, and proper playback typically requires not allowing the dialog to move around with other moving audio objects. The estimate importance function 906 in FIG. 9 includes an audio classification component that automatically estimates the content type of an audio object to determine whether or not the audio object is dialog, or some other type of important or unimportant type of object.

Figure 10:
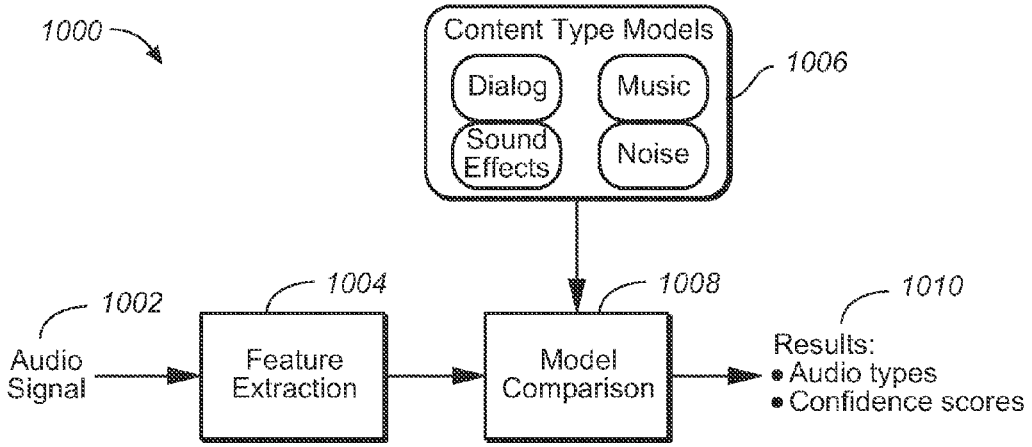
FIG. 10 is a functional diagram of an audio classification component, under an embodiment.

FIG. 10 is a functional diagram of an audio classification component, under an embodiment. As shown in diagram 1000, an input audio signal 1002 is processed in a feature extraction module that extracts features representing the temporal, spectral, and/or spatial property of the input audio signal. A set of pre-trained models 1006 representing the statistical property of each target audio type is also provided. For the example of FIG. 10, the models include dialog, music, sound effects, and noise, though other models are also possible, and various machine learning techniques can be applied for model training. The model information 1006 and extracted features 1004 are input to a model comparison module 1008. This module 1008 compares the features of the input audio signal with the model of each target audio type, computes the confidence score of each target audio type, and estimates the best matched audio types. A confidence score for each target audio type is further estimated, representing the probability or the matched level between the to-be-identified audio object and the target audio type, with values from 0 to 1 (or any other appropriate range). The confidence scores can be computed depending on different machine learning methods, for example, the posterior probability can be directly used as a confidence score for Gaussian Mixture Model (GMM), and sigmoid fitting can be used to approximate confidence score for Support Vector Machine (SVM) and AdaBoost. Other similar machine learning methods can also be used. The output 1010 of the model comparison module 1008 comprises the audio type or types and their associated confidence score(s) for the input audio signal 1002.

With regard to estimating content-based audio object importance, for dialog oriented applications, the content-based audio object importance is computed based on the dialog confidence score only, assuming that dialog is the most important component in audio as stated above. In other applications, different content types confidence scores may be used, depending on the preferred type of content. In one embodiment, a sigmoid function is utilized, as provided in the following equation:

$$I_k = \frac{1}{1 + e^{Ap_k + B}}$$

In the above equation, $I_k$ is the estimated content-based importance of object k, $p_k$ is the corresponding estimated probability of object k consisting of speech/dialogue, and A and B are two parameters.

In order to further set the content-based importance to consistently close to 0 for those with dialog probability scores less than a threshold c, the above formula can be modified as follows:

$$I_k = \frac{1}{1 + e^{A \cdot max(p_k - c, 0) + B}}$$

In an embodiment, the constant c, can take the value of c=0.1, and the two parameters A and B can be either constants or adaptively tuned based on the probability score $p_k$.

With regard to calculating object partial loudness, one method to calculate partial loudness of one object in a complex auditory scene is based on the calculation of excitation levels E(b) in critical bands (b). The excitation level for a certain object of interest $E_{obj}(b)$ and the excitation of all remaining (masking) signals $E_{noise}(b)$ results in a specific loudness N'(b) in band b, as provided in the following equation:

$$N'(b)=C[(GE_{obj}+GE_{noise}+A)^{\alpha}-A^{\alpha}]-C[(GE_{noise}+A)^{\alpha}-A^{\alpha}],$$

with G, C, A and □ model parameters. Subsequently, the partial loudness N is obtained by summing the specific loudness N'(b) across critical bands as follows:

$$N=\Sigma_b N'(b)$$

When an auditory scene consists of K objects (k=1, . . . , K) with excitation levels $E_k(b)$, and for simplicity of notation, model parameters G and C are assumed to be equal to +1, the specific loudness $N'_k$ (b) of object k is given by:

$$N'_k(b)=(A+\Sigma_m E_m(b))^{\alpha}-(-E_k(b)+A+\Sigma_m(b))^{\alpha}$$

The first term in the equation above represents the overall excitation of the auditory scene, plus an excitation A that reflects the absolute hearing threshold. The second term reflects the overall excitation except for the object of interest k, and hence the second term can be interpreted as a 'masking' term that applies to object k. This formulation does not account for a binaural release from masking. A release from masking can be incorporated by reducing the masking term above if the object of interest k is distant from another object m as given by the following equation:

$$N'_k(b)=(A+\Sigma_m E_m(b))^{\alpha}-(-E_k(b)+A+\Sigma_m E_m(b)(1-f(k,m)))^{\alpha},$$

In the above equation, f(k,m) is a function that equals 0 if object k and object m have the same position, and a value that is increasing to +1 with increasing spatial distance between objects k and m. Said differently, the function f(k,m) represents the amount of unmasking as a function of the distance in parametric positions of objects k and m. Alternatively, the maximum value of f(k,m) may be limited to a value slightly smaller than +1 such as 0.995 to reflect an upper limit in the amount of spatial unmasking for objects that are spatially separated.

The calculation of loudness can be accounted for by a defined cluster centroid. In general, a centroid is the location in attribute space that represents the center of a cluster, and an attribute is a set of values corresponding to a measurement (e.g., loudness, content type, etc.). The partial loudness of individual objects is only of limited relevance if objects are clustered, and if the goal is to derive a constrained set of clusters and associated parametric positions that provides the best possible audio quality. In an embodiment, a more representative metric is the partial loudness accounted for by a specific cluster position (or centroid), aggregating all excitation in the vicinity of that position. Similar to the case above, the partial loudness accounted for by cluster centroid c can be expressed as follows:

$$N'_c(b)=(A+\Sigma_m E_m(b))^{\alpha}-(A+\Sigma_m E_m(b)(1-f(m,c)))^{\alpha}$$

In this context, an output bed channel (e.g., an output channel that should be reproduced by a specific loudspeaker in a playback system) can be regarded as a centroid with a fixed position, corresponding to the position of the target loudspeaker. Similarly, input bed signals can be regarded as objects with a position corresponding to the position of the corresponding reproduction loudspeaker. Hence objects and bed channels can be subjected to the exact same analysis, under the constraint that bed channel positions are fixed.

In an embodiment, the loudness and content analysis data are combined to derive a combined object importance value, as shown in block 1108 of FIG. 11. This combined value based on partial loudness and content analysis can be obtained by modifying the loudness and/or excitation of an object by the probability of that object being perceptually important. For example, the excitation of object k can be modified as follows:

$$E'_k(b)=E_k(b)g(I_k)$$

In the above equation, $I_k$ is the content-based object importance of object k, $E'_k(b)$ is the modified excitation level, and g(·) is a function to map the content importance into excitation level modifications. In an embodiment, g(·) is an exponential function interpreting the content importance as a gain in db.

$$g(I_k)=10^{GI_k}$$

where G is another gain over the content-based object importance, which can be tuned to obtain the best performance.

In another implementation, g(·) is a linear function, as follows:

$$g(I_k)=1+G\cdot I_k$$

The above equations are merely examples of possible embodiments. Alternative methods can be applied onto loudness instead of excitation, and may include ways of combining information other than involving a simple product.

As also shown in FIG. 11, embodiments also include a method of smoothing loudness based on content importance (1110). Loudness is usually smoothed over frames to avoid rapid change of object position. The time constant of the smoothing process can be adaptively adjusted based on the content importance. In this manner, for more important objects, the time constant can be larger (smoothing slowly) so that the more important objects can be consistently selected as the cluster centroid over frames. This is also improves the stability of centroid selection for dialog, since a dialog usually alternates spoken words and pauses, in which the loudness may be low at pauses, thus causing other objects to be selected as the centroid. This results in the finally selected centroids to switch between dialog and other objects, thus causing potential instability.

In one embodiment, the time constant is positively correlated to the content-based object importance, as follows:

$$\tau=\tau_0+I_k\cdot\tau_1$$

In the above equation, τ is the estimated importance dependent time constant, and $\tau_0$ and $\tau_1$ are parameters. Moreover, similar to the excitation/loudness level modification based on content importance, the adaptive time constant scheme can be also applied onto either loudness or excitation.

Figure 12:
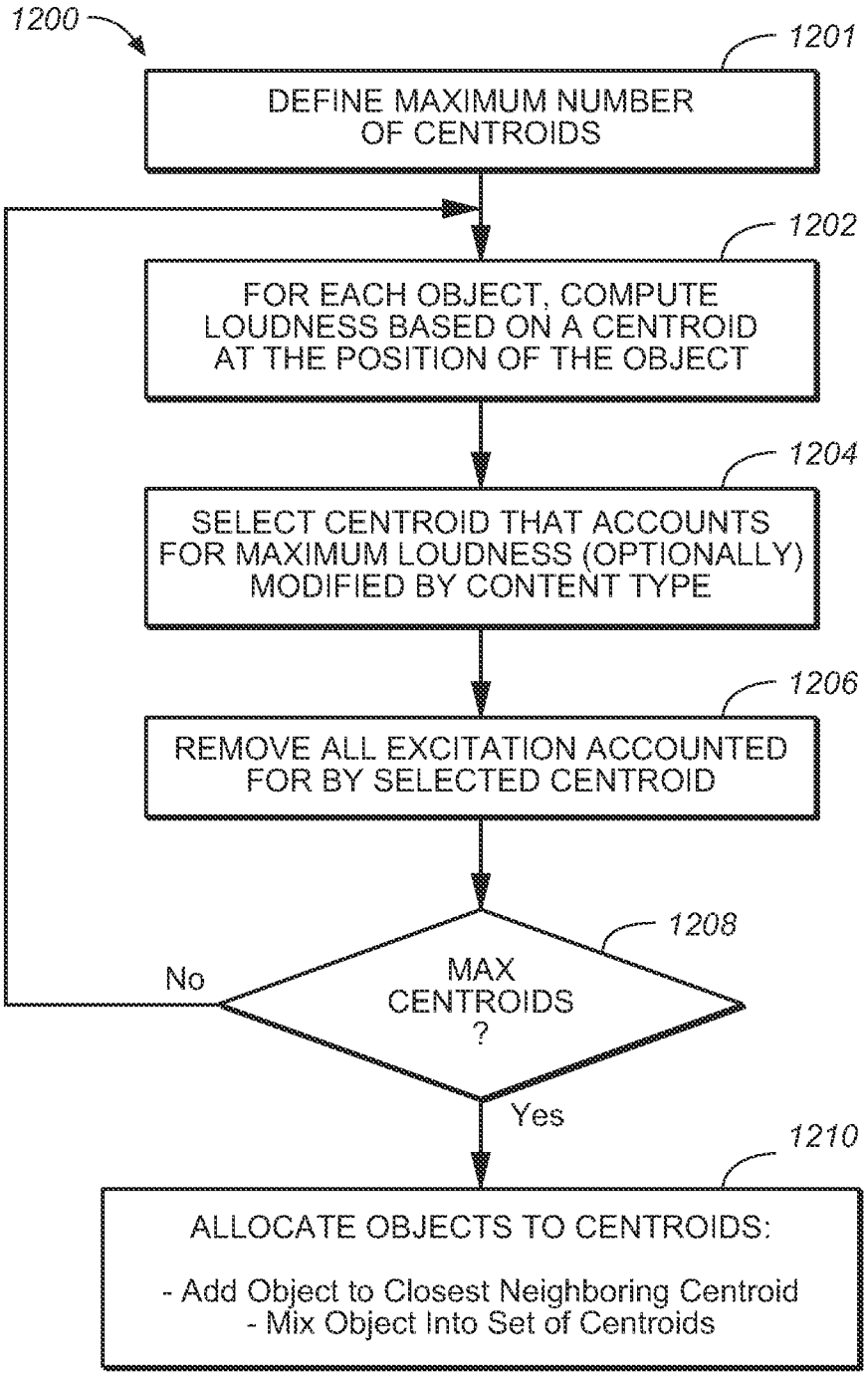
FIG. 12 is a flowchart that illustrates a process of calculating cluster centroids and allocating objects to selected centroids, under an embodiment.

As stated above, the partial loudness of audio objects is calculated with respect to a defined cluster centroid. In an embodiment, a cluster centroid calculation is performed such that when the total number of clusters is constrained, a subset of cluster centroids is selected that accounts for the maximum partial loudness of the centroids. FIG. 12 is a flowchart that illustrates a process of calculating cluster centroids and allocating objects to selected centroids, under an embodiment. Process 1200 illustrates an embodiment of deriving a limited set of centroids based on object loudness values. The process begins by defining the maximum number of centroids in the limited set (1201). This constrains the clustering of audio objects so that certain criteria, such as spatial error, are not violated. For each audio object, the process computes the loudness accounted for given a centroid at the position of that object (1202). The process then selects the centroid that accounts for maximum loudness, optionally modified for content type (1204), and removes all excitation accounted for by the selected centroid (1206). This process is repeated until the maximum number of centroids defined in block 1201 is obtained, as determined in decision block 1208.

In an alternative embodiment, the loudness processing could involve performing a loudness analysis on a sampling of all possible positions in the spatial domain, followed by selecting local maxima across all positions. In a further alternative embodiment, Hochbaum centroid selection is augmented with loudness. The Hochbaum centroid selection is based on the selection of a set of positions that have maximum distance with respect to one another. This process can be augmented by multiplying or adding loudness to the distance metric to select centroids.

As shown in FIG. 12, once the maximum number of centroids has been processed, the audio objects are allocated to appropriate selected centroids (1210). Under this method, when a proper subset of cluster centroids is selected, objects can be allocated to centroids by either adding the object to its closest neighboring centroid, or mixing the object into a set or subset of centroids, for example by means of triangulation, using vector decomposition, or any other means to minimize the spatial error of the object.

Figure 13A:
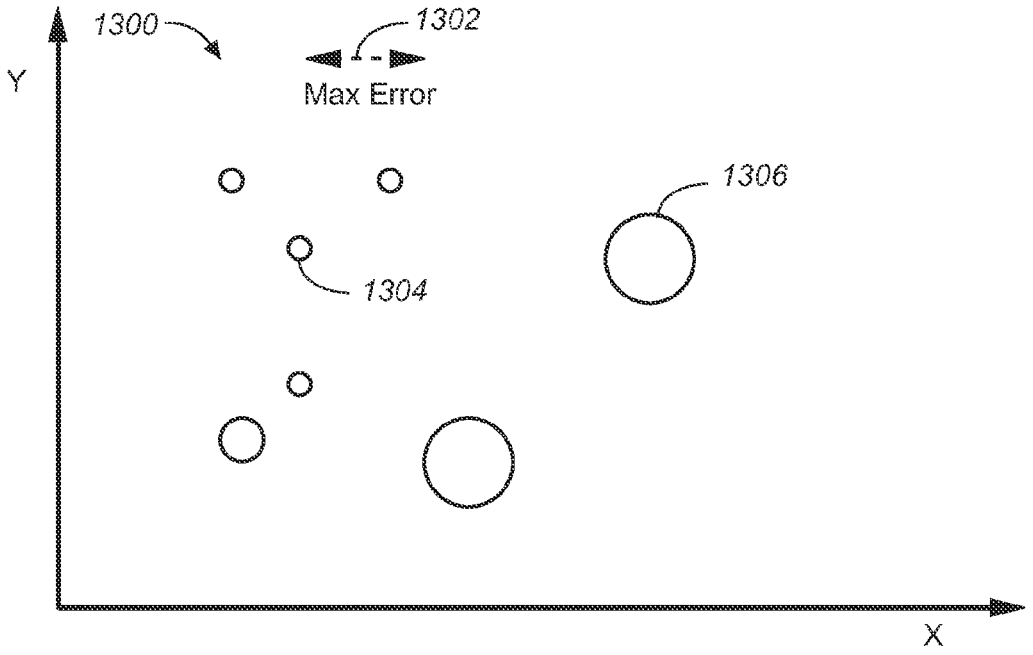
FIGS. 13A and 13B illustrate the grouping of objects into clusters based on certain perceptual criteria, under an embodiment.
Figure 13B:
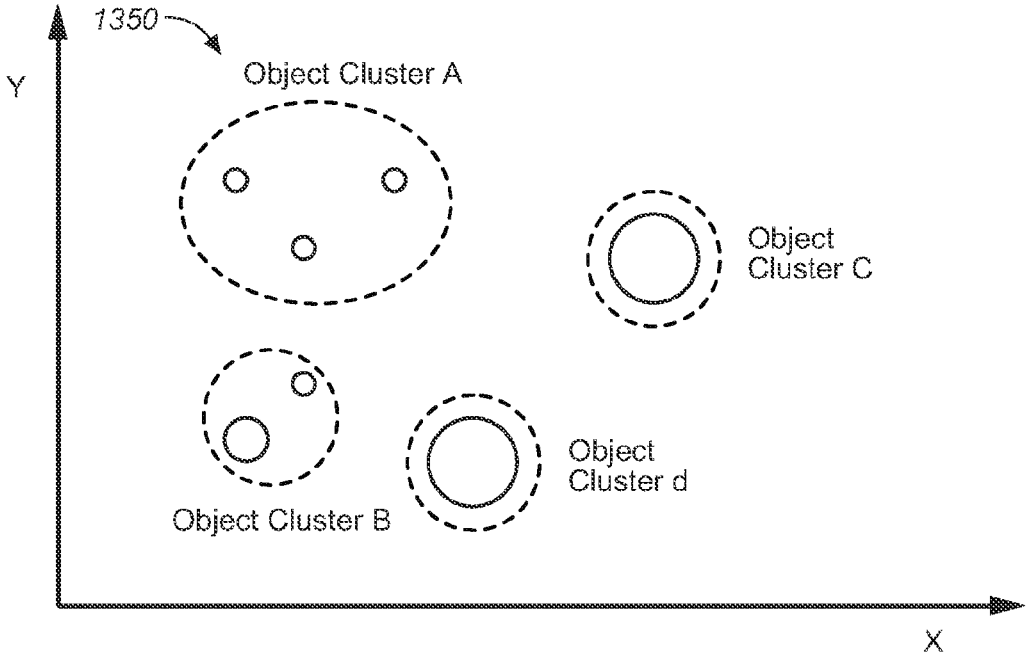

FIGS. 13A and 13B illustrate the grouping of objects into clusters based on certain perceptual criteria, under an embodiment. Diagram 1300 illustrates the position of different objects in two-dimensional object space represented as an X/Y spatial coordinate system. The relative size of the objects represents their relative perceptual importance so that larger objects (e.g., 1306) are of higher importance than smaller objects (e.g., 1304). In an embodiment, the perceptual importance is based on the relative partial loudness values and content type of each respective object. The clustering process analyzes the objects to form clusters (groups of objects) that tolerate more spatial error, wherein the spatial error may be defined in relation to a maximum error threshold value 1302. Based on appropriate criteria, such as the error threshold, a maximum number of clusters, and other similar criteria, the objects may be clustered in any number of arrangements.

FIG. 13B illustrates a possible clustering of the objects of FIG. 13A for a particular set of clustering criteria. Diagram 1350 illustrates the clustering of the seven objects in diagram 1300 into four separate clusters, denoted clusters A-D. For the example shown in FIG. 13B, cluster A represents a combination of low importance objects that tolerate more spatial error; clusters C and D represent clusters based on sources that are of high enough importance that they should be rendered separately; and cluster B represents a case where a low importance object can be grouped high importance object. The configuration of FIG. 13B is intended to represent just one example of a possible clustering scheme for the objects of FIG. 13A, and many different clustering arrangements can be selected.

In an embodiment, the clustering process select n centroids within the X/Y plane for clustering the objects, where n is the number of clusters. The process selects the n centroids that correspond to the highest importance, or maximum loudness accounted for. The remaining objects are then clustered according to (1) nearest neighbor, or (2) rendered into the cluster centroids by panning techniques. Thus, audio objects can be allocated to clusters by adding the object signal of a clustered object to the closest centroid, or mixing the object signal into a (sub)set of clusters. The number of selected clusters may be dynamic and determined through mixing gains that minimize the spatial error in a cluster. The cluster metadata consists of weighted averages of the objects that reside in the cluster. The weights may be based on the perceived loudness, as well as object position, size, zone, exclusion mask, and other object characteristics. In general, clustering of objects is primarily dependent on object importance and one or more objects may be distributed over multiple output clusters. That is, an object may be added to one cluster (uniquely clustered), or it may be distributed over more than one cluster (non-uniquely clustered).

As shown in FIGS. 13A and 13B, the clustering process dynamically groups an original number of audio objects and/or bed channels into a target number of new equivalent objects and bed channels. In most practical applications, the target number is substantially lower than the original number, e.g., 100 original input tracks combined into 20 or fewer combined groups. These solutions apply to scenarios where both bed and object channels are available either as an input and/or an output to the clustering process. A first solution to support both objects and bed tracks is to process input bed tracks as objects with fixed pre-defined position in space. This allows the system to simplify a scene comprising, for example, both objects and beds into a target number of object tracks only. However, it might also be desirable to preserve a number of output bed tracks as part of the clustering process. Less important objects can then be rendered directly to the bed tracks as a pre-process, while the most important ones can be further clustered into a smaller target number of equivalent object tracks. If some of the resulting clusters have high distortion they can also be rendered to beds as a post-process, as this may result in a better approximation of the original content. This decision can be made on a time-varying basis, since the error/distortion is a time-varying function.

In an embodiment, the clustering process involves analyzing the audio content of every individual input track (object or bed) as well as the attached metadata (e.g., the spatial position of the objects) to derive an equivalent number of output object/bed tracks that minimizes a given error metric. In a basic implementation, the error metric 1302 is based on the spatial distortion due to shifting the clustered objects and can further be weighted by a measure of the importance of each object over time. The importance of an object can encapsulate other characteristics of the object, such as loudness, content type, and other relevant factors. Alternatively, these other factors can form separate error metrics that can be combined with the spatial error metric.

Object and Channel Processing

Figure 14:
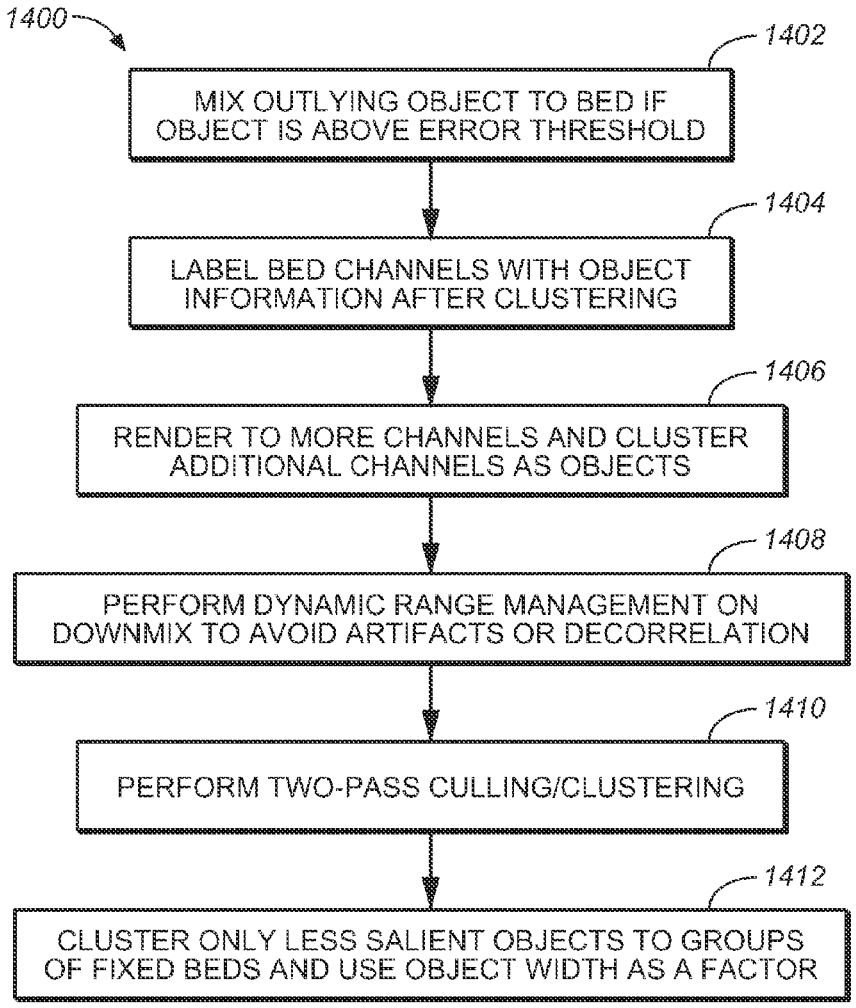
FIG. 14 is a flowchart that illustrates a method of clustering objects and beds, under an embodiment.

In an adaptive audio system, certain objects may be defined as fixed objects, such as channel beds that are associated with specific speaker feeds. In an embodiment, the clustering process accounts for bed plus dynamic object interaction, such that when an object creates too much error when being grouped with a clustered object (e.g., it is an outlying object), it is instead mixed to a bed. FIG. 14 illustrates components of a process flow for clustering audio objects and channel beds, under an embodiment. The method 1400 shown in FIG. 14, it is assumed that beds are defined as fixed position objects. Outlying objects are then clustered (mixed) with one or more appropriate beds if the object is above an error threshold for clustering with other objects (1402). The bed channel(s) are then labeled with the object information after clustering (1404). The process then renders the audio to more channels and clusters additional channels as objects (1406), and performs dynamic range management on downmix or smart downmix to avoid artifacts/decorrelation, phase distortion, and the like (1408). The process performs a two-pass culling/clustering process (1410). In an embodiment, this involves keeping the N most salient objects separate, and clustering the remaining objects. Thus, the process clusters only less salient objects to groups or fixed beds (1412). Fixed beds can be added to a moving object or a clustered object, which may be more suitable for particular endpoint devices, such as headphone virtualization. The object width may be used as a characteristic of how many and which objects are clustered together and where they will be spatially rendered following clustering.

Playback System

Figure 15:
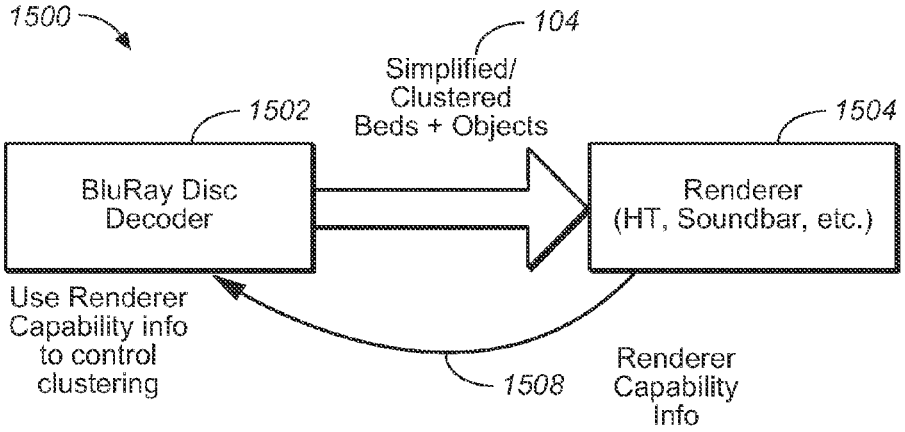
FIG. 15 illustrates rendering clustered object data based on end-point device capabilities, under an embodiment

As described above, various different end-point devices may be used in conjunction with a rendering system that employs a clustering process as described herein, and such devices may have certain capabilities that may impact the clustering process. FIG. 15 illustrates rendering clustered object data based on end-point device capabilities, under an embodiment. As shown in diagram 1500, a Blu-ray disc decoder 1502 produces simplified audio scene content comprising clustered beds and objects for rendering through a soundbar, home theater system, personal playback device, or some other limited processing playback system 1504. The characteristics and capabilities of the end-point device is transmitted as renderer capability information 1508 back to the decoder stage 1502 so that the clustering of objects can be performed optimally based on the specific end-point device being used.

The adaptive audio system employing aspects of the clustering process may comprise a playback system that is configured render and playback audio content that is generated through one or more capture, pre-processing, authoring and coding components. An adaptive audio pre-processor may include source separation and content type detection functionality that automatically generates appropriate metadata through analysis of input audio. For example, positional metadata may be derived from a multi-channel recording through an analysis of the relative levels of correlated input between channel pairs. Detection of content type, such as speech or music, may be achieved, for example, by feature extraction and classification. Certain authoring tools allow the authoring of audio programs by optimizing the input and codification of the sound engineer's creative intent allowing him to create the final audio mix once that is optimized for playback in practically any playback environment. This can be accomplished through the use of audio objects and positional data that is associated and encoded with the original audio content. In order to accurately place sounds around an auditorium, the sound engineer needs control over how the sound will ultimately be rendered based on the actual constraints and features of the playback environment. The adaptive audio system provides this control by allowing the sound engineer to change how the audio content is designed and mixed through the use of audio objects and positional data. Once the adaptive audio content has been authored and coded in the appropriate codec devices, it is decoded and rendered in the various components of the playback system.

In general, the playback system may be any professional or consumer audio system, which may include home theater (e.g., A/V receiver, soundbar, and Blu-ray), E-media (e.g., PC, Tablet, Mobile including headphone playback), broadcast (e.g., TV and set-top box), music, gaming, live sound, user generated content, and so on. The adaptive audio content provides enhanced immersion for the consumer audience for all end-point devices, expanded artistic control for audio content creators, improved content dependent (descriptive) metadata for improved rendering, expanded flexibility and scalability for consumer playback systems, timbre preservation and matching, and the opportunity for dynamic rendering of content based on user position and interaction. The system includes several components including new mixing tools for content creators, updated and new packaging and coding tools for distribution and playback, in-home dynamic mixing and rendering (appropriate for different consumer configurations), additional speaker locations and designs Aspects of the audio environment of described herein represents the playback of the audio or audio/visual content through appropriate speakers and playback devices, and may represent any environment in which a listener is experiencing playback of the captured content, such as a cinema, concert hall, outdoor theater, a home or room, listening booth, car, game console, headphone or headset system, public address (PA) system, or any other playback environment. The spatial audio content comprising object-based audio and channel-based audio may be used in conjunction with any related content (associated audio, video, graphic, etc.), or it may constitute standalone audio content. The playback environment may be any appropriate listening environment from headphones or near field monitors to small or large rooms, cars, open air arenas, concert halls, and so on.

Aspects of the systems described herein may be implemented in an appropriate computer-based sound processing network environment for processing digital or digitized audio files. Portions of the adaptive audio system may include one or more networks that comprise any desired number of individual machines, including one or more routers (not shown) that serve to buffer and route the data transmitted among the computers. Such a network may be built on various different network protocols, and may be the Internet, a Wide Area Network (WAN), a Local Area Network (LAN), or any combination thereof. In an embodiment in which the network comprises the Internet, one or more machines may be configured to access the Internet through web browser programs.

One or more of the components, blocks, processes or other functional components may be implemented through a computer program that controls execution of a processor-based computing device of the system. It should also be noted that the various functions disclosed herein may be described using any number of combinations of hardware, firmware, and/or as data and/or instructions embodied in various machine-readable or computer-readable media, in terms of their behavioral, register transfer, logic component, and/or other characteristics. Computer-readable media in which such formatted data and/or instructions may be embodied include, but are not limited to, physical (non-transitory), non-volatile storage media in various forms, such as optical, magnetic or semiconductor storage media.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

While one or more implementations have been described by way of example and in terms of the specific embodiments, it is to be understood that one or more implementations are not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A method of compressing object-based audio data comprising:

determining a perceptual importance of objects in an audio scene, wherein the objects comprise object audio data and associated metadata;

combining certain audio objects into clusters of audio objects based on the determined perceptual importance of the audio objects, wherein a number of clusters is less than an original number of audio objects in the audio scene, and wherein said combining certain audio objects into clusters comprises selecting centroids for the clusters that correspond to the audio objects having the highest perceptual importance and distributing at least one of the remaining audio objects over more than one of the clusters by panning techniques.

2. The method of claim 1 wherein the perceptual importance is derived from the object audio data of the audio objects.

3. The method of claim 1 wherein the perceptual importance is a value derived from at least one of a loudness value and a content type of a respective audio object, and wherein the content type is selected from the group consisting of: dialog, music, sound effects, ambiance, and noise.

4. The method of claim 3 wherein the content type is determined by an audio classification process, and wherein the loudness value is obtained by a perceptual model.

5. The method of claim 4 wherein the perceptual model is based on a calculation of excitation levels in critical frequency bands of the input audio signal, and wherein the method further comprises:

defining a centroid for a cluster around a first audio object of the audio objects;

aggregating all excitations of the audio objects; and, optionally smoothing the excitation levels, the loudness or properties derived thereof based on a time constant derived by a relative perceptual importance of a grouped audio object.

6. The method of claim 3 wherein the loudness value is dependent at least in part on spatial proximity of a respective audio object to the other audio objects, and optionally wherein the spatial proximity is defined at least in part by a position metadata value of the associated metadata for the respective audio object.

7. The method of claim 1 wherein the determined perceptual importance of the audio objects depends on a relative spatial location of the audio objects in the audio scene, and wherein the step of combining comprises:

determining a number of centroids, each centroid comprising a center of a cluster for grouping a plurality of audio objects, the centroid positions being dependent on the perceptual importance of one or more audio objects relative to other audio objects; and grouping the audio objects into one or more clusters by distributing audio object signals across the clusters.

8. The method of claim 1 wherein cluster metadata is determined by one or more audio objects of a high perceptual importance.

9. The method of claim 1 wherein the combining causes certain spatial errors associated with each clustered audio object, and further wherein the method further comprises clustering the audio objects such that a spatial error is minimized for audio objects of relatively high perceptual importance.

10. A non-transitory storage medium comprising a software program, which when executed on a computing device, causes the computing device to perform the method of claim 1.

11. The method of claim 1, wherein combining certain audio objects into clusters further comprises:

combining waveforms embodying the audio data for constituent audio objects within the same cluster together to form a replacement audio object having a combined waveform of the constituent audio objects; and combining the metadata for the constituent audio objects within the same cluster together to form a replacement set of metadata for the constituent audio objects.

12. A method of processing object-based audio comprising:

determining a first spatial location of each audio object relative to the other audio objects of the plurality of audio objects;

determining a relative importance of each audio object of the plurality of audio objects, said relative importance depending on the relative spatial locations of audio objects, by at least determining a partial loudness of each audio object of the plurality of audio objects, wherein the partial loudness of an audio object is based at least in part on a masking effect of one or more other audio objects;

determining a number of centroids, each centroid comprising a center of a cluster for grouping a plurality of audio objects, the centroid positions being dependent on the relative importance of one or more audio objects;

combining waveforms embodying the audio data for constituent audio objects within the same cluster together to form a replacement audio object having a combined waveform of the constituent audio objects; and combining the metadata for the constituent audio objects within the same cluster Nether to form a replacement set of metadata for the constituent audio objects.

13. The method of claim 12 further comprising determining a content type and associated content type importance of each audio object of the plurality of audio objects.

14. The method of claim 13 further comprising combining the partial loudness and the content type of each audio object to determine the relative importance of a respective audio object, and optionally wherein the content type is selected from the group consisting of: dialog, music, sound effects, ambiance, and noise.

15. The method of claim 12 wherein the partial loudness is obtained by a perceptual model that is based on a calculation of excitation levels in critical frequency bands of the input audio signal, and wherein the method further comprises:

defining a centroid for a cluster around a first audio object of the audio objects; and aggregating all excitations of the audio objects.

16. The method of claim 12 wherein grouping the audio objects causes certain spatial errors associated with each clustered audio object, and wherein the method further comprises grouping the audio objects such that a spatial error is minimized for audio objects of relatively high perceptual importance.

17. The method of claim 16 further comprising one of: selecting the audio object having the highest perceptual importance as a cluster centroid for a cluster containing the audio object having the highest perceptual importance, or selecting an audio object that has a maximum loudness as a cluster centroid for a cluster containing the audio object that has the maximum loudness.

18. A non-transitory storage medium comprising a software program, which when executed on a computing device, causes the computing device to perform the method of claim 12.

19. An apparatus for compressing object-based audio data, comprising one or more processors configured to:

determine a perceptual importance of objects in an audio scene, wherein the objects comprise object audio data and associated metadata;

combine certain audio objects into clusters of audio objects based on the determined perceptual importance of the audio objects, wherein a number of clusters is less than an original number of audio objects in the audio scene, and wherein said combining certain audio objects into clusters comprises selecting centroids for the clusters that correspond to the audio objects having the highest perceptual importance and distributing at least one of the remaining audio objects over more than one of the clusters by panning techniques.

20. An apparatus for processing object-based audio, comprising one or more processors configured to:

determine a first spatial location of each audio object relative to the other audio objects of the plurality of audio objects;

determine a relative importance of each audio object of the plurality of audio objects, said relative importance depending on the relative spatial locations of audio objects, by at least determining a partial loudness of each audio object of the plurality of audio objects, wherein the partial loudness of an audio object is based at least in part on a masking effect of one or more other audio objects;

determine a number of centroids, each centroid comprising a center of a cluster for grouping a plurality of audio objects, the centroid positions being dependent on the relative importance of one or more audio objects;

combining waveforms embodying the audio data for constituent audio objects within the same cluster together to form a replacement audio object having a combined waveform of the constituent audio objects; and combining the metadata for the constituent audio objects within the same cluster together to form a replacement set of metadata for the constituent audio objects.

* * * * *